US011721931B2

(12) United States Patent
Ma et al.

(10) Patent No.: US 11,721,931 B2
(45) Date of Patent: Aug. 8, 2023

(54) SAFETY SOCKET MODULE, AND POWER STRIP AND MOBILE CABLE REEL COMPRISING SAME

(71) Applicant: DALIAN SAFE TECHNOLOGY CO., LTD, Liaoning (CN)

(72) Inventors: Wen Ma, Liaoning (CN); Junge Ma, Liaoning (CN); Liwei Cao, Liaoning (CN)

(73) Assignee: DALIAN SAFE TECHNOLOGY CO., LTD, Liaoning (CN)

( * ) Notice: Subject to any disclaimer, the term of this patent is extended or adjusted under 35 U.S.C. 154(b) by 0 days.

(21) Appl. No.: 18/008,672

(22) PCT Filed: Oct. 12, 2020

(86) PCT No.: PCT/CN2020/120463

§ 371 (c)(1),
(2) Date: Dec. 7, 2022

(87) PCT Pub. No.: WO2021/248758

PCT Pub. Date: Dec. 16, 2021

(65) Prior Publication Data

US 2023/0178924 A1 Jun. 8, 2023

(30) Foreign Application Priority Data

Jun. 8, 2020 (CN) ..... 202010513546.2

(51) Int. Cl.
*H01R 13/52* (2006.01)
*H01R 13/703* (2006.01)
(Continued)

(52) U.S. Cl.
CPC ..... *H01R 13/5202* (2013.01); *H01R 13/502* (2013.01); *H01R 13/629* (2013.01); *H01R 13/7031* (2013.01)

(58) Field of Classification Search
CPC ..... H01R 13/5202; H01R 13/502; H01R 13/629; H01R 13/7031
See application file for complete search history.

(56) References Cited

U.S. PATENT DOCUMENTS

2018/0183177 A1* 6/2018 Yamanaka ..... H01R 13/648
2020/0144763 A1* 5/2020 Lee ..... H01R 13/5227

FOREIGN PATENT DOCUMENTS

CN 202217858 5/2012
CN 102931509 2/2013
(Continued)

OTHER PUBLICATIONS

"International Search Report (Form PCT/ISA/210) of PCT/CN2020/120463", dated Mar. 10, 2021, with English translation thereof, pp. 1-6.

*Primary Examiner* — Abdullah A Riyami
*Assistant Examiner* — Nader J Alhawamdeh
(74) *Attorney, Agent, or Firm* — JCIP Global Inc.

(57) ABSTRACT

A safety socket module includes: a shell; an upper cover, configured to cover the shell, where jacks are provided on the upper cover; compartments, where the number of the compartments corresponds to the number of the jacks, each of the compartments is arranged in the shell and below a respective jack of the jacks, and an interior of each of the compartments is accessible from an exterior of the shell through the respective jack; waterproof electrical connection switches, arranged in the compartments and configured to asynchronously control connection and disconnection of a circuit between a power supply and a plug of an electric appliance; and lock control members, respectively arranged in the compartments and aligned with the jacks; where each of the waterproof electrical connection switches includes a waterproof capsule, and a movable contact piece and a static
(Continued)

contact piece arranged opposite to each other in the waterproof capsule.

17 Claims, 13 Drawing Sheets

(51) Int. Cl.
*H01R 13/629* (2006.01)
*H01R 13/502* (2006.01)

(56) References Cited

FOREIGN PATENT DOCUMENTS

| | | | |
|---|---|---|---|
| CN | 203180257 | | 9/2013 |
| CN | 203180257 U | * | 9/2013 |
| CN | 105261876 | | 1/2016 |
| CN | 105576418 | | 5/2016 |
| CN | 206098895 | | 4/2017 |
| CN | 208656040 | | 3/2019 |
| CN | 110165509 | | 8/2019 |
| CN | 210272927 | | 4/2020 |
| CN | 111682343 | | 9/2020 |

* cited by examiner

SAFETY SOCKET MODULE, AND POWER STRIP AND MOBILE CABLE REEL COMPRISING SAME

CROSS-REFERENCE TO RELATED APPLICATION

This application is a 371 of international application of PCT application serial no. PCT/CN2020/120463, filed on Oct. 12, 2020, which claims the priority benefit of China application no. 202010513546.2, filed on Jun. 8, 2020. The entirety of each of the above—mentioned patent applications is hereby incorporated by reference herein and made a part of this specification.

TECHNICAL FIELD

The present disclosure relates to the field of electrical technologies, and specifically to a safety socket module and a power strip including the safety socket module.

BACKGROUND

With the improvement of people's living standards, the number of household appliances kept in each family is gradually increasing. Therefore, as a device that provides a power interface for household appliances, the demand for sockets and power strips has increased sharply. At the same time, people also have higher requirements for the safety performance of sockets and power strips. In daily life, a child may intentionally or unintentionally touch a jack of a socket or power strip with a finger, or insert a conductor into the jack, causing electric shock accidents. In addition, in bathrooms or other wet and watery environments (such as outdoor construction in rainy and snowy days), water is likely to enter a socket or a power strip from a jack, leading to electric shock and short circuit accidents.

Some sockets and power strips in the prior art have certain moisture-proof, waterproof and electric-shock-proof functions. These functions are generally implemented by methods such as arranging a waterproof cover on sockets and power strips, arranging a leakage and short circuit protection device on sockets and power strips, arranging an anti-touch protection door on sockets and power strips, arranging a waterproof sealing gasket on sockets and power strips, etc. However, the above-mentioned solutions still have defects in reliability and safety. The rubber material used to seal the jack will wear out after repeated plugging and unplugging, resulting in an attenuation or loss of the sealing effect and consequently a current leakage risk. Although the waterproof cover can prevent splashing, the reliability is still not high, because the waterproof cover will be lifted and lose its protective effect after a plug of an electric appliance is inserted into a jack. In addition, the waterproof cover cannot prevent water intrusion, and it is not safe to use the waterproof cover outdoors, low-lying places, basements and other places prone to water accumulation. The sealing gasket has a certain protective effect when used in water with low pressure, but its protective effect tends to be ineffective in deep water or places with high pressure.

Based on the above, the solutions in the prior art can be used within a certain range, but cannot meet the safety requirements in special environments. In addition, there are still problems in the reliability and service life of waterproof sockets and power strips in the prior art, causing safety risks. Therefore, there is an urgent need to develop sockets and power strips with higher waterproof, leakage-proof and electric-shock-proof performance.

SUMMARY

A main objective of the present disclosure is to provide a safety socket module with a simple structure and high reliability, and a power strip including the safety socket module. The above safety socket module and power strip can provide effective waterproof and electric-shock-proof performances.

The present disclosure discloses a safety socket module, including: a shell; an upper cover, configured to cover the shell and provided with a plurality of jacks; compartments, where a number of the compartments corresponds to a number of the jacks, each of the compartments is arranged in the shell and below a respective jack of the jacks, and an interior of each of the compartments is accessible from an exterior of the shell through the respective jack; waterproof electrical connection switches, arranged in the compartments and configured to asynchronously control connection and disconnection of a circuit between a power supply and a plug of an electric appliance; and lock control members, respectively arranged in the compartments and aligned with the jacks, and configured to clamp pins of the plug of the electric appliance and bias the waterproof electrical connection switches when the pins are inserted into the jacks, respectively, and disengage from the pins and reset the waterproof electrical connection switches when the pins are pulled out of the jacks, respectively. The biasing refers to lateral or outward pressing. When the pin is inserted into the jack, the pin may cause the lock control member to move laterally and/or rotate outward to produce lateral or outward pressing. Each of the waterproof electrical connection switches includes an isolated waterproof chamber, and a movable contact piece and a static contact piece arranged opposite to each other in the isolated waterproof chamber. The isolated waterproof chamber is configured as a fully sealed structure, and a contact surface of the isolated waterproof chamber that is biased by a respective lock control member of the lock control members is elastically deformable. The movable contact piece is configured to contact with the static contact piece to switch on each of the waterproof electrical connection switches through biasing of the respective lock control member when the pins are inserted into the jacks, and move away from the static contact piece to switch off each of the waterproof electrical connection switches through resetting of the respective lock control member when the pins are pulled out of the jacks.

According to an optional embodiment, the safety socket module further includes a gasket, arranged between the compartments and the upper cover to seal the compartments and prevent a liquid from penetrating from one compartment to another compartment; a connection part of each of the waterproof electrical connection switches connected to a conductor in a bottom of the shell and an exposed part of the conductor are covered with a waterproof insulating material for a waterproof treatment; and a connection part of each of the lock control members connected to a conductor in the bottom of the shell and an exposed part of the conductor are covered with a waterproof insulating material for a waterproof treatment. The waterproof electrical connection switch is connected to another waterproof electrical connection switch or a lock control member through the conductor.

According to an optional embodiment, the isolated waterproof chamber is a waterproof capsule, and the waterproof capsule includes a capsule base and a waterproof rubber sleeve fixed to the capsule base. The movable contact piece and the static contact piece are arranged inside the waterproof rubber sleeve, and the capsule base is formed by injection molding, and the movable contact piece and the static contact piece are fixed to the capsule base at the same time. An insulating elastic piece is arranged between the movable contact piece and the static contact piece to assist and correct a deformation and a rebound of the movable contact piece and the static contact piece. The movable contact piece and the static contact piece are respectively provided with contacts. The movable contact piece and the static contact piece are configured to contact with each other through the contacts.

According to an optional embodiment, the capsule base is made of an insulating material by injection molding. The waterproof rubber sleeve is integrally made of an insulating, heat-resistant, and friction-resistant elastic material.

According to an optional embodiment, a waterproof pad made of an insulating material is arranged on the upper cover. The waterproof pad is configured to cover a part of the upper cover and expose the jacks, and is configured to fit with the plug of the electric appliance to prevent water from entering the compartments through a gap between the plug of the electric appliance and the upper cover when the plug of the electric appliance is inserted into the jacks, and block a communication of water between the pins of the plug on a surface of the upper cover.

According to an optional embodiment, a multi-rib waterproof structure made of an insulating material is arranged on the upper cover, and is configured to fit with a rubber pad mounted on the plug of the electric appliance to prevent water from entering the compartments through a gap between the plug of the electric appliance and the upper cover when the plug of the electric appliance is inserted into the jacks, and block a communication of water between the pins of the plug on a surface of the upper cover.

According to an optional embodiment, at least two waterproof electrical connection switches controlled by the lock control members in different compartments are connected in series between a live wire of the power supply and the lock control member in the compartment of the safety socket module corresponding to the live wire. At least one waterproof electrical connection switch is connected in series between a neutral wire of the power supply and the lock control member in the compartment of the safety socket module corresponding to the neutral wire.

According to an optional embodiment, at least two waterproof electrical connection switches controlled by the lock control members in different compartments are connected in series between a live wire of the power supply and the lock control member in the compartment of the safety socket module corresponding to the live wire; and at least two waterproof electrical connection switches controlled by the lock control members in different compartments are connected in series between a neutral wire of the power supply and the lock control member in the compartment of the safety socket module corresponding to the neutral wire.

According to an optional embodiment, the upper cover is provided with a live wire jack corresponding to a live wire pin of the plug of the electric appliance and a neutral wire jack corresponding to a neutral wire pin of the plug of the electric appliance. The safety socket module includes a live wire compartment arranged below the live wire jack in the shell and a neutral wire compartment arranged below the neutral wire jack in the shell. Two waterproof electrical connection switches are arranged in each of the live wire compartment and the neutral wire compartment to form a protection circuit controlled by four switches.

According to an optional embodiment, the upper cover is provided with a live wire jack corresponding to a live wire pin of the plug of the electric appliance, a neutral wire jack corresponding to a neutral wire pin of the plug of the electric appliance, and a ground wire jack corresponding to a ground wire pin of the plug of the electric appliance. The safety socket module includes a live wire compartment arranged below the live wire jack in the shell, a neutral wire compartment arranged below the neutral wire jack in the shell, and a ground wire compartment arranged below the ground wire jack in the shell. A total of four waterproof electrical connection switches are arranged in the live wire compartment, the neutral wire compartment, and the ground wire compartment to form a protection circuit controlled by four switches.

According to an optional embodiment, the upper cover is provided with three live wire jacks corresponding to live wire pins of the plug of the electric appliance and a ground wire jack corresponding to a ground wire pin of the plug of the electric appliance. The safety socket module includes live wire compartments respectively arranged below the live wire jacks in the shell and a ground wire compartment arranged below the ground wire jack in the shell. At least two waterproof electrical connection switches controlled by the lock control members in different compartments are connected in series between each live wire of the power supply and the lock control member in each of the live wire compartments. A total of six waterproof electrical connection switches are arranged in the live wire compartments and the ground wire compartment to form a protection circuit controlled by six switches.

According to an optional embodiment, each of the lock control members is made of a conductor material by integral molding and includes a push paddle arranged perpendicularly to a bottom surface of a respective one of the compartments and a fixing component, and the fixing component includes a pair of two clamping pieces; a plane where the push paddle lies is perpendicular to a plane where the fixing component lies; and the push paddle includes a bend near an end portion thereof, the bend includes a first bending portion abutting against a respective one of the waterproof electrical connection switches and a second bending portion facing toward a respective pin of the pins, and a spacing of the push paddle is set to match a width of the respective pin. When the respective pin is inserted, the respective pin enters into contact with the second bending portion, and a distance by which the second bending portion moves laterally is transmitted to the movable contact piece in the respective one of the waterproof electrical connection switches through the first bending portion abutting against the respective one of the waterproof electrical connection switches. This distance is sufficient to provide a good contact between the movable contact piece and the static contact piece. In this way, the push paddle biases the movable contact piece to contact with the static contact piece only when a pin conforming to a size specified in a standard is inserted into a respective jack of the jacks, and does not bias the movable contact piece to contact with the static contact piece when a pin or other conductor not conforming to the size specified in the standard is inserted into the respective jack, so as to prevent an electric shock, and the push paddle resets when the respective pin is pulled out of the respective jack.

The two clamping pieces are opposite to each other, each of the clamping pieces is provided near an end portion thereof with a bending portion facing toward the respective pin, and a distance between the two clamping pieces is set to match a thickness of the respective pin, so that the respective pin is tightly clamped by the bending portions of the clamping pieces to prevent a poor contact when being inserted into the respective jack, and the clamping pieces reset when the respective pin is pulled out of the respective jack. The bending angle and shape of the bending portion may be adjusted according to the required clamping degree. For example, a pointed bending portion provides a larger clamping force than a smooth bending portion. In practice, the clamping degree can be adjusted by selecting a suitable bending portion.

According to an optional embodiment, the bending portion of each of the clamping pieces is closer to the respective jack than the bend of the push paddle is, to ensure that when the respective pin is inserted into the respective jack, the respective pin is first tightly clamped by the pair of clamping pieces and then pushes the push paddle, so as to prevent the generation of an electric arc when the respective pin is inserted.

According to an optional embodiment, each of the lock control members is made of a conductor material and includes a split-molded push paddle arranged on a respective one of the compartments and a pair of clamping pieces arranged perpendicularly to a bottom surface of the respective one of the compartments.

According to an optional embodiment, a cross-section of the push paddle is configured substantially in a V-shape with an opening facing downward, a top end of the push paddle is a hinge point, one side edge of the push paddle is close to a respective jack of the jacks, and the other side edge of the push paddle is covered with an insulating bush and abuts against a respective one of the waterproof electrical connection switches. An angle between the two side edges of the push paddle is set to match a width of a respective pin of the pins, so that the push paddle biases the movable contact piece to contact with the static contact piece only when a pin conforming to a size specified in a standard is inserted into the respective jack, and does not bias the movable contact piece to contact with the static contact piece when a pin or other conductor not conforming to the size specified in the standard is inserted into the respective jack, so as to prevent an electric shock, and that the push paddle resets when the respective pin is pulled out of the respective jack. The two clamping pieces are opposite to each other, each of the clamping pieces is provided near an end portion thereof with a bending portion facing toward the respective pin, and a distance between the two clamping pieces is configured to match a thickness of the respective pin, so that the respective pin is tightly clamped by the bending portions of the clamping pieces to prevent a poor contact when being inserted into the respective jack, and the clamping pieces reset when the respective pin is pulled out of the respective jack.

The present disclosure also discloses a power strip, including: a power strip shell, an external power cable connected externally into the power strip shell, and an internal power cable arranged in the power strip shell. One or more safety socket modules are embedded in the power strip shell. The power strip shell is configured to expose the upper cover(s) of the one or more safety socket modules. The one or more safety socket modules are connected in parallel to the internal power cable. The external power cable is connected to the internal power cable through a mechanical switch.

According to an optional embodiment, the mechanical switch includes: a switch button having a depressed position and a raised position, a push member connected to the switch button, and a switch waterproof capsule abutting against the push member. The switch waterproof capsule includes a switch movable contact piece and a switch static contact piece opposite to each other therein. The switch movable contact piece is connected to one of the external power cable and the internal power cable, and the switch static contact piece is connected to the other of the external power cable and the internal power cable. The switch movable contact piece is configured to contact with the switch static contact piece to connect the external power cable to the internal power cable through biasing of the push member when the switch button is in the depressed position, and to move away from the switch static contact piece to disconnect the external power cable from the internal power cable through a retraction of the push member when the switch button is in the raised position.

According to an optional embodiment, the mechanical switch includes two switch waterproof capsules. The switch movable contact piece and the switch static contact piece of one of the switch waterproof capsules are respectively connected to a live wire of the external power cable and a live wire of the internal power cable. The switch movable contact piece and the switch static contact piece of the other of the switch waterproof capsules are respectively connected to a neutral wire of the external power cable and a neutral wire of the internal power cable. Each of the switch waterproof capsules controls closing and opening of a circuit.

The present disclosure also discloses a mobile cable reel, including: a drum; two baffles, respectively arranged on two opposing sides of the drum; a cable reel power cable, coiled on an outer periphery of the drum; one or more safety socket modules according to any one of the above embodiments, arranged on one or both of the two baffles; and one or more drain openings, arranged on one or both of the two baffles and corresponding to the one or more safety socket modules.

By the above technical features, during using the safety socket module, the power strip and the mobile cable reel according to the present disclosure either in a general environment or in water, inserting a conductor into a single jack will neither cause an electric shock, nor cause an electric current in water. In the above environments, when multiple conductors are inserted into all the jacks at the same time, there will be no risk of electric shock and short circuit as long as the widths and lengths of the conductors are less than sizes specified in national standards. Before the plug of the electric appliance is inserted into the jacks, the waterproof electrical connection switch is switched off, and water may enter the safety socket module and the power strip through the jacks, without causing any short circuit. After the plug is inserted into the jacks, the waterproof electrical connection switch is switched on. In this case, because the gap between the plug of the electric appliance and the upper cover is sealed by the waterproof pad or the multi-rib waterproof structure, external water cannot enter the safety socket module, and at the same time the communication of water between the pins of the plug on the surface of the upper cover is blocked, so no short circuit or current leakage will occur. Therefore, the safety socket module, the power strip and the mobile cable reel according to the present disclosure have a waterproof function and can be used in water immersion.

BRIEF DESCRIPTION OF THE DRAWINGS

The foregoing and other aspects of the present disclosure will be more fully understood and appreciated from the following detailed description made with reference to the accompanying drawings, in which.

DETAILED DESCRIPTION OF THE EMBODIMENTS

In order to help those skilled in the art to accurately understand the subject matter claimed in the present disclosure, specific embodiments of the present disclosure will be described in detail below in conjunction with the accompanying drawings.

Figure 1:
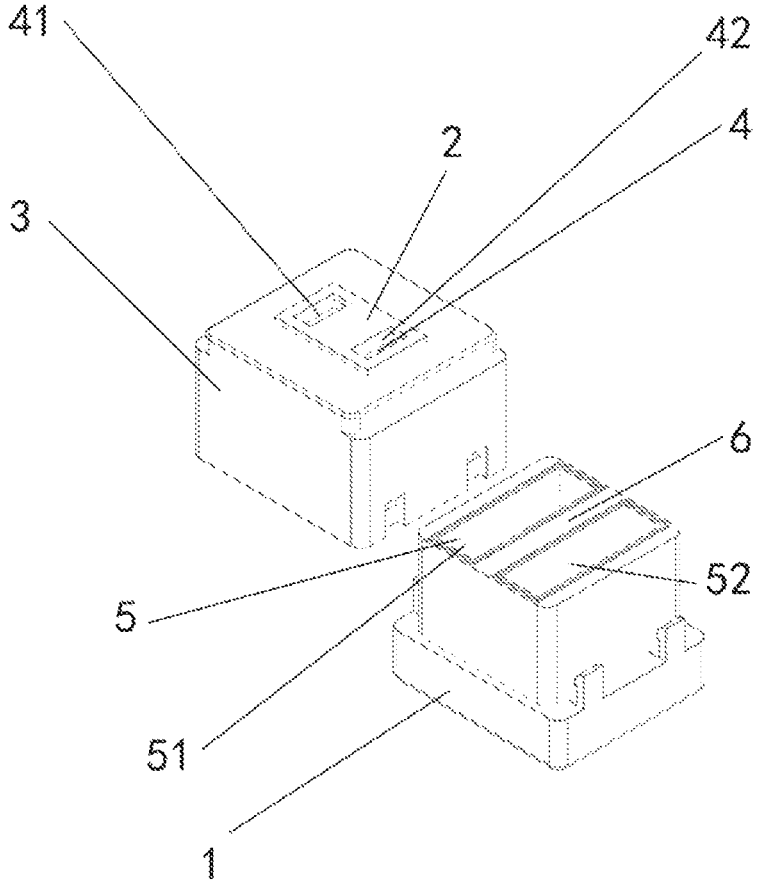
FIG. 1 is a three-dimensional diagram of a safety socket module according to the present disclosure.

FIG. 1 is a three-dimensional diagram of a safety socket module according to the present disclosure. The safety socket module includes: a shell 1; an upper cover 3, configured to cover the shell 1, where a plurality of jacks 4 are provided on the upper cover 3; compartments 5, where the number of the compartments 5 corresponds to the number of the jacks 4, each of the compartments 5 is arranged in the shell 1 and below a respective jack of the jacks 4, and an interior of each of the compartments 5 is accessible from an exterior of the shell 1 through the respective jack 4; and a gasket 6, arranged between the compartments 5 and the upper cover 3 to seal the compartments 5 and prevent a liquid from penetrating from one compartment 5 to another compartment 5. The upper cover 3 is provided with a live wire jack 41 corresponding to a live wire pin of a plug of an electric appliance and a neutral wire jack 42 corresponding to a neutral wire pin of the plug of the electric appliance. The safety socket module includes a live wire compartment 51 arranged below the live wire jack in the shell 1 and a neutral wire compartment 52 arranged below the neutral wire jack in the shell. A waterproof pad 2 made of an insulating material is arranged on the upper cover 3. The waterproof pad 2 is configured to cover a part of the upper cover 3 and expose the jacks 4, and is configured to fit with the plug of the electric appliance to prevent water from entering the compartments 5 through a gap between the plug of the electric appliance and the upper cover 3 when the plug of the electric appliance is inserted into the jacks 4, and block a communication of water between the pins of the plug on a surface of the upper cover.

Figure 2:
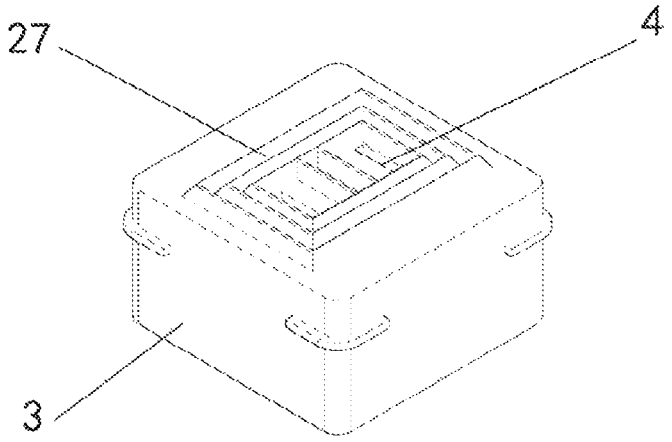
FIG. 2 is a three-dimensional diagram of a safety socket module according to another embodiment of the present disclosure.

FIG. 2 is a three-dimensional diagram of a safety socket module according to another embodiment of the present disclosure. The embodiment in FIG. 2 differs from the embodiment in FIG. 1 in that: the upper cover 3 is provided with a multi-rib waterproof structure 27, and the plug of the electric appliance is equipped with a waterproof insulating rubber pad, which is used in combination with the multi-rib waterproof structure 27 to provide a stronger waterproof performance. Ribs and recesses formed by the multi-rib waterproof structure 27 are in contact with the waterproof insulating rubber pad under pressing, which can effectively prevent water from entering and moving between different ribs and recesses. In this way, water is prevented from entering the compartments 5 through the gap between the plug of the electric appliance and the upper cover 3 when the plug of the electric appliance is inserted into the jacks 4, and the communication of water between pins of the plug on the surface of the upper cover 3 is blocked.

Figure 3:
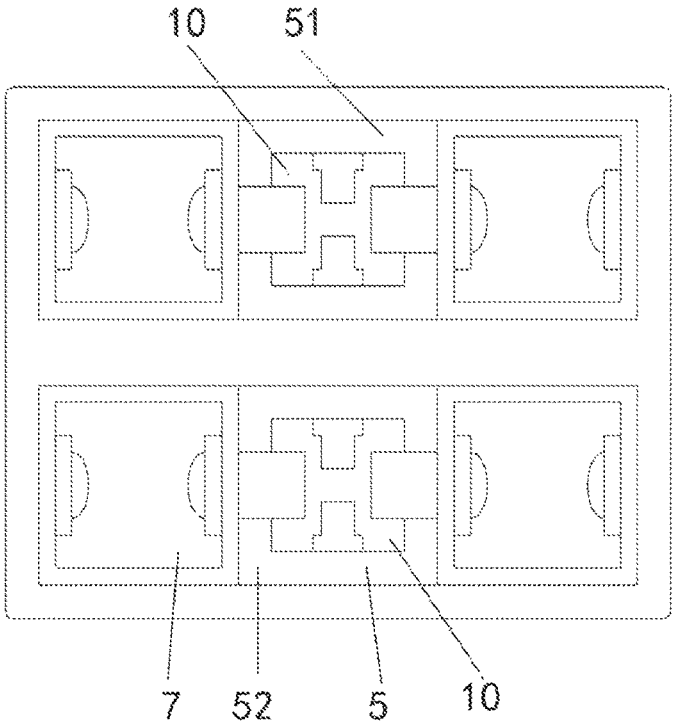
FIG. 3 is a top view of the safety socket module in FIG. 1.

FIG. 3 is a top view of the safety socket module in FIG. 1, where the upper cover 3 is removed for convenience of description. The safety socket module includes: waterproof electrical connection switches 7, arranged in the compartments 5 and configured to asynchronously control connection and disconnection of a circuit between a power supply and a plug of an electric appliance; and lock control members 10, respectively arranged in the compartments and aligned with the jacks, and configured to clamp pins (not shown) of the plug of the electric appliance and bias the waterproof electrical connection switches 7 when the pins are inserted into the jacks 4, respectively, and disengage from the pins and reset the waterproof electrical connection switches 7 when the pins are pulled out of the jacks 4, respectively. In a preferred solution, the lock control members are configured to undergo a standard deformation of the lock control members when standard pins are inserted into the jacks, respectively, and produce a lateral or outward standard movement distance to bias the waterproof electrical connection switches, so as to switch on the waterproof electrical connection switches. In a specific solution, the standard pin is a pin conforming to a size specified in a standard, which mainly means that the width of the pin conforms to the size specified in the standard, and further includes that the thickness of the pin conforms to the dimension specified in the standard. In a first embodiment, the compartments 5 include the live wire compartment 51 and the neutral wire compartment 52, and two waterproof electrical connection switches 7 are arranged in each of the live wire compartment 51 and the neutral wire compartment 52 to form a protection circuit controlled by four switches. A connection part of each of the waterproof electrical connection switches 7 connected to a conductor in a bottom of the shell and an exposed part of the conductor are covered with a waterproof insulating material for a waterproof treatment. For example, the waterproof electrical connection switch 7 is connected to another part through a copper sheet, and an insulating material is poured to cover the connection part and the copper sheet. Alternatively, the waterproof electrical connection switch 7 is connected to another part through an insulated wire, and then the connection part is injection molded with an insulating material. A connection part of each of the lock control members 10 connected to a conductor in the bottom of the shell and an exposed part of the conductor are covered with a waterproof insulating material (for example, covered by pouring an insulating material or connected by an insulated wire) for a waterproof treatment.

Figure 4:
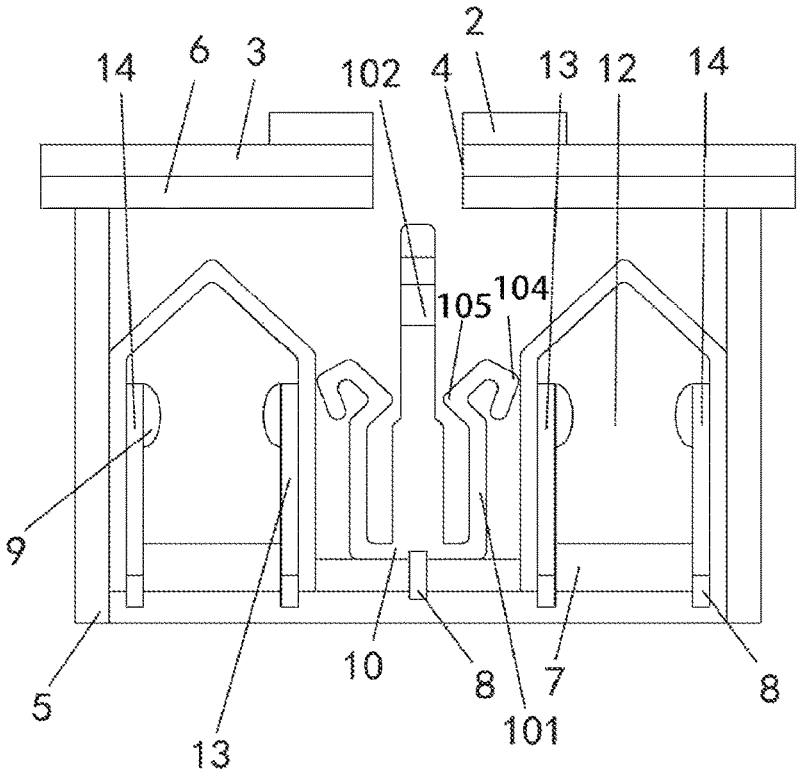
FIG. 4 is a side view of the safety socket module in FIG. 1.

FIG. 4 is a side view of the safety socket module in FIG. 1. The waterproof electrical connection switch 7 includes an isolated waterproof chamber, and a movable contact piece 13 and a static contact piece 14 arranged opposite to each other in the isolated waterproof chamber. The isolated waterproof chamber is configured as a fully sealed structure, and a contact surface of the isolated waterproof chamber that is biased by a respective lock control member of the lock control members is elastically deformable. In a preferred solution, the isolated waterproof chamber is a waterproof capsule 12. The movable contact piece 13 is configured to contact with the static contact piece 14 to switch on the waterproof electrical connection switch 7 through biasing of the lock control member 10 when the pin is inserted into the jack 4, and move away from the static contact piece to switch off the waterproof electrical connection switch 7 through resetting of the lock control member 10 when the pin is pulled out of the jack 4. In a solution, a pin conforming to the size specified in the standard in the plug is inserted into the jack 4. Due to the insertion, the lock control member 10 is deformed and biases the elastically deformable surface of the isolated waterproof chamber, and the elastically deformable surface is deformed to bias the movable contact piece 13. Under the biasing, the movable contact piece moves and contacts with the static contact piece 14 to switch on the waterproof electrical connection switch 7. When the pin is pulled out of the jack 4, the movable contact piece moves away from the static contact piece through the resetting of the lock control member 10 to switch off the waterproof electrical connection switch 7. For safety considerations, the movable contact piece 13 and the static contact piece 14 in the waterproof capsule 12, when not connected to the movable contact piece 13 and the static contact piece 14 in the waterproof capsule 12 in any other compartment 5, are not connected to the movable contact piece 13 and the static contact piece 14 in any other waterproof capsule 12 in the same compartment 5. In a multi-switch control circuit, the circuit needs to be closed by joint triggering of the lock control members 10 in different compartments. A conductive connector 8 in the waterproof capsule is configured to extend through the bottom of the compartment 5 and the waterproof capsule 12 to provide an electrical connection of the movable contact piece 13 and the static contact piece 14 to the lock control member 10 or other components. The conductive connector 8 in the waterproof capsule 12 may be an extension of the movable contact piece 13 or the static contact piece 14, i.e., the movable contact piece 13 or the static contact piece 14 is integrally formed with the corresponding conductive connector 8; or an independent conductive connector 8 may be connected to the movable contact piece 13 or the static contact piece 14. A conductive connector 8 in the lock control member 10 is configured to extend through the bottom of the compartment 5 to provide an electrical connection of the lock control member 10 to the movable contact piece 13 or the static contact piece 14 or other components. The conductive connector 8 in the lock control member 10 may be integrally formed with the lock control member 10; or an independent conductive connector 8 may be connected to the lock control member 10. The movable contact piece 13 and the static contact piece 14 are respectively provided with contacts 9. The movable contact piece 13 and the static contact piece 14 are configured to contact with each other through the contacts 9. The contacts 9 may be fixed on the movable contact piece 13 and the static contact piece 14 by welding.

Figure 24:
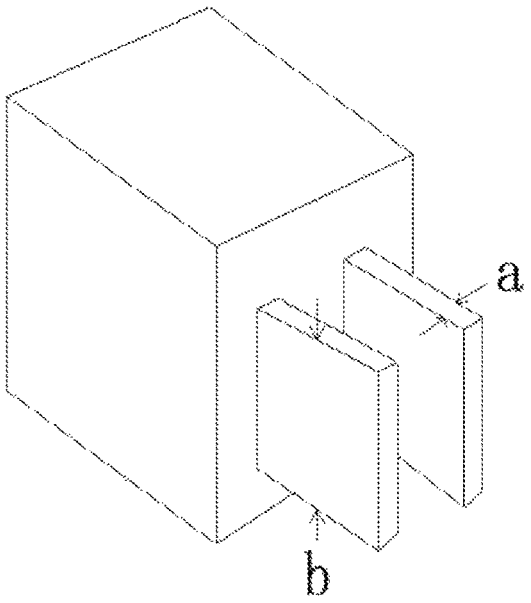
FIG. 24 is a schematic diagram of a thickness direction and a width direction of a pin of a plug.

The lock control member 10 is made of a conductor material and includes a push paddle 101 arranged perpendicularly to a bottom surface of the compartment and a fixing component. In a preferred solution, the lock control member 10 is made of the conductor material by integral molding, and the fixing component includes a pair of clamping pieces 102. The conductor material may be phosphor bronze. A plane where the push paddle 101 lies is perpendicular to a plane where the fixing component lies. The push paddle 101 includes a bend near an end portion thereof, the bend includes a first bending portion 104 abutting against the waterproof electrical connection switch 7 and a second bending portion 105 facing toward the pin, and a spacing of the push paddle 101 is set to match a width of the pin (distance b in FIG. 24). When the pin is inserted into the jack 4, the pin enters into contact with the second bending portion 105, and a distance by which the second bending portion 105 moves laterally is transmitted to the movable contact piece 13 in the waterproof electrical connection switch 7 through the first bending portion 104 abutting against the waterproof electrical connection switch 7. This distance is sufficient to provide a good contact between the movable contact piece 13 and the static contact piece 14. In this way, the push paddle 101 biases the movable contact piece 13 to contact with the static contact piece 14 only when a pin conforming to a size specified in a standard is inserted into the jack, and cannot bias the movable contact piece 13 to contact with the static contact piece 14 when a pin or other conductor not conforming to the size specified in the standard is inserted into the jack, so as to prevent an electric shock, and the push paddle 101 resets when the pin is pulled out of the jack 4.

Figure 25:
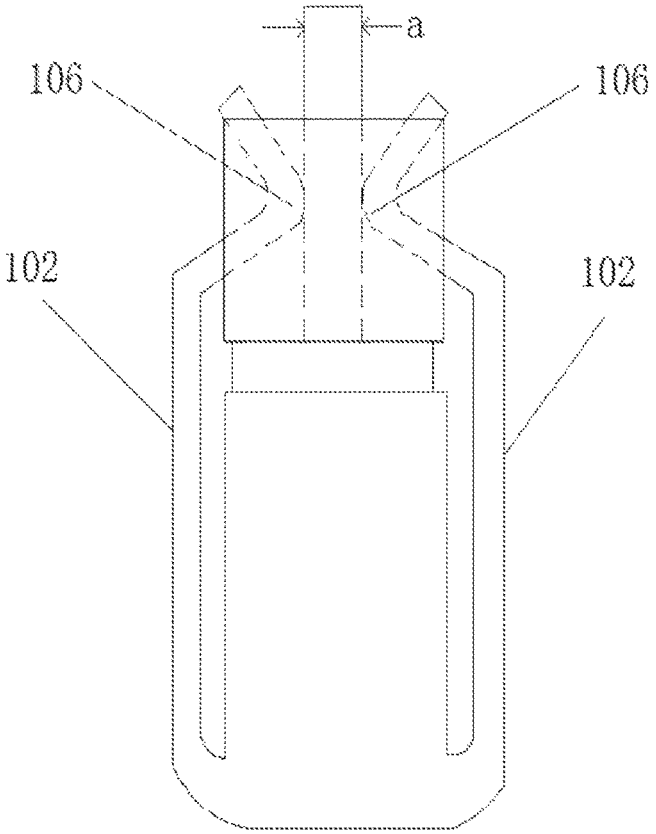
FIG. 25 is a schematic diagram of a pin inserted between clamping pieces.

As shown in FIG. 25, the two clamping pieces 102 are opposite to each other, each of the clamping pieces 102 is provided near an end portion thereof with a bending portion 106 facing toward the pin, and a distance between the two clamping pieces 102 is set to match a thickness of the pin (distance a in FIG. 24), so that the pin is tightly clamped by the bending portions 106 of the clamping pieces 102 when being inserted into the jack 4, so as to prevent poor contact, and the clamping pieces reset when the pin is pulled out of the jack 4.

The bending portion of each of the clamping pieces 102 is closer to the jack 4 than the bend of the push paddle 101 is, to ensure that when the pin is inserted into the jack 4, the pin is first tightly clamped by the pair of clamping pieces 102 and then pushes the push paddle, so as to prevent the generation of an electric arc.

Figure 5:
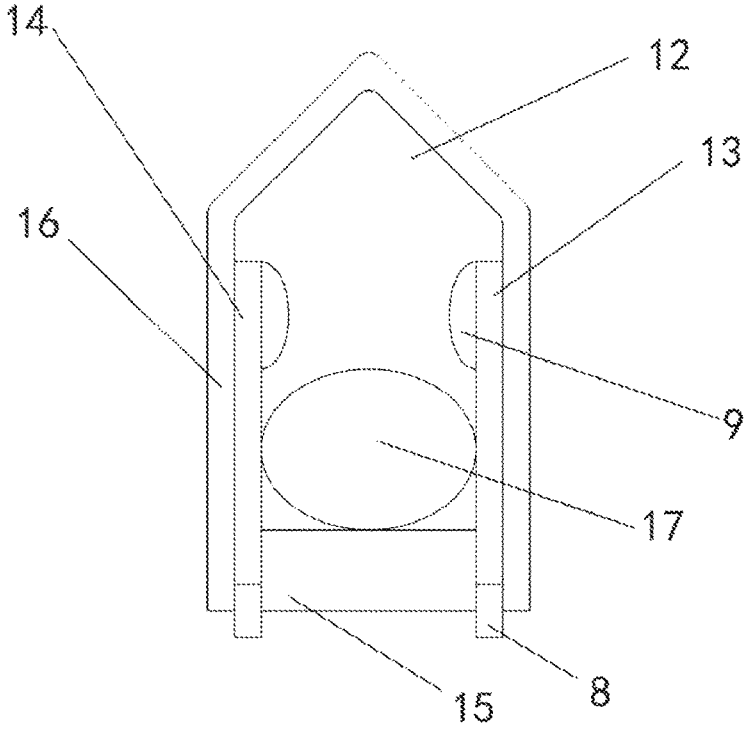
FIG. 5 is a cross-sectional view of a waterproof electrical connection switch of a safety socket module according to another embodiment of the present disclosure.

FIG. 5 is a cross-sectional view of a waterproof electrical connection switch of a safety socket module according to another embodiment of the present disclosure. The waterproof capsule 12 includes a capsule base 15 and a waterproof rubber sleeve 16 fixed to the capsule base 15. The waterproof rubber sleeve 16 may be bonded to the capsule base 15 by a waterproof adhesive. The movable contact piece 13 and the static contact piece 14 are arranged inside the waterproof rubber sleeve 16 and fixed to the capsule base 15 by injection molding. The capsule base 15 is made of an insulating material by injection molding. The waterproof rubber sleeve 16 is integrally made of an insulating, heat-resistant, and friction-resistant elastic material, for example, by integral molding, high-frequency welding or other processes.

The above elastic material may be silica gel. The embodiment in FIG. 5 differs from the embodiment in FIG. 4 in that: an insulating elastic piece 17 is arranged between the movable contact piece 13 and the static contact piece 14 to assist and correct the deformation and rebound of the movable contact piece 13 and the static contact piece 14.

Figure 6:
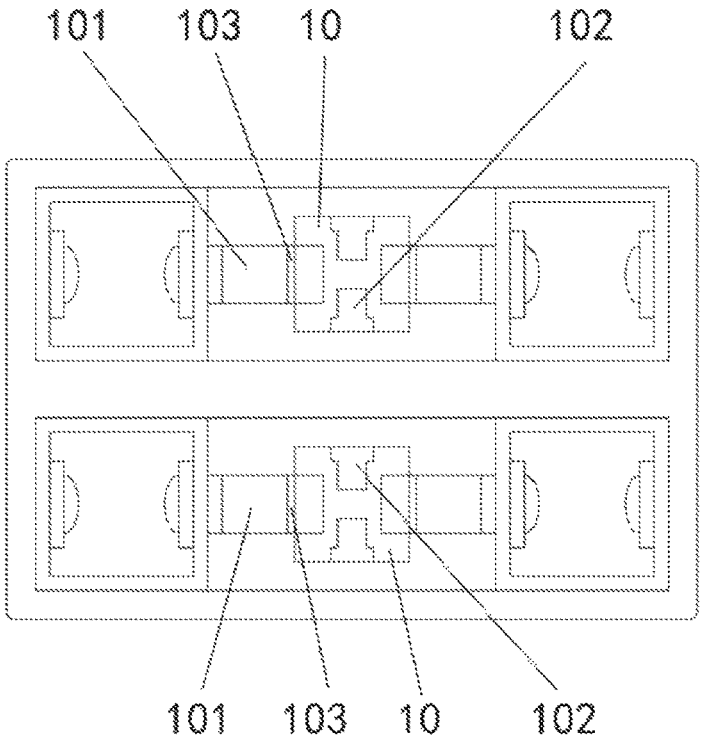
FIG. 6 is a top view of a safety socket module according to another embodiment of the present disclosure.

FIG. 6 is a top view of a safety socket module according to another embodiment of the present disclosure. The embodiment in FIG. 6 differs from the embodiment in FIG. 3 in that: the lock control member 10 is made of a conductor material and includes a push paddle 101 hinged on the compartment 5 and a pair of clamping pieces 102 arranged perpendicularly to a bottom surface of the compartment. The conductor material may be phosphor bronze. As shown in FIG. 25, each of the clamping pieces 102 is provided near an end portion thereof with a bending portion 106 facing toward the pin, and a distance between the two clamping pieces 102 is set to match a thickness of the pin (distance a in FIG. 24), so that the pin is tightly clamped by the bending portions 106 of the clamping pieces 102 when being inserted into the jack 4, so as to prevent poor contact, and the clamping pieces reset when the pin is pulled out from the jack 4.

Figure 7:
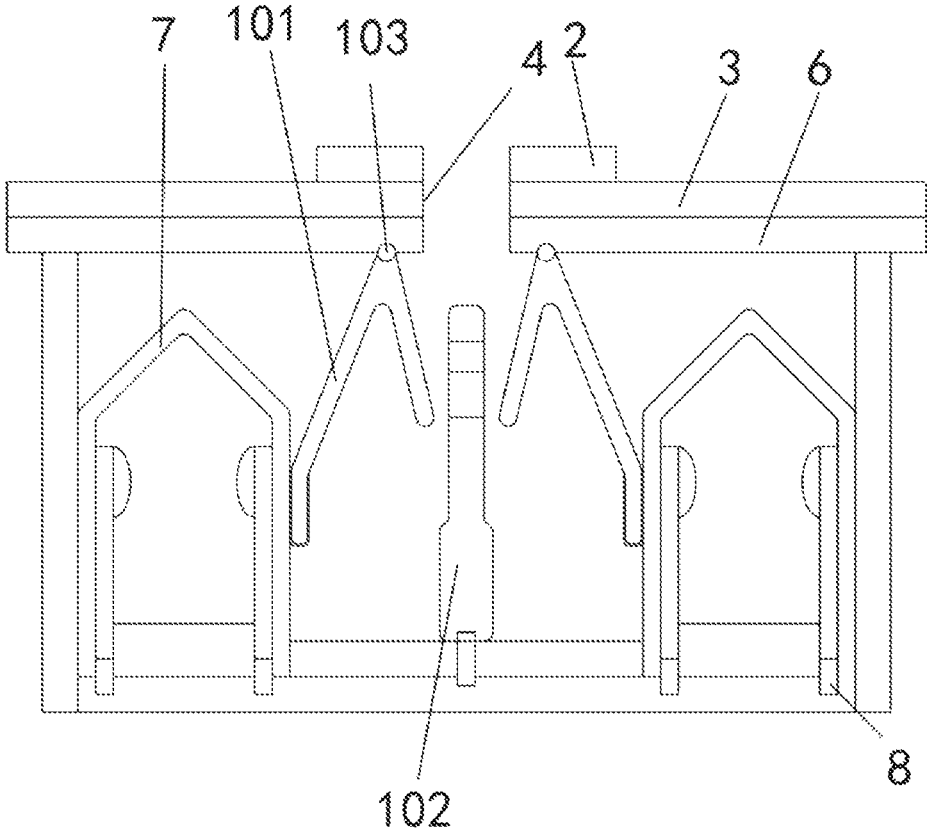
FIG. 7 is a side view of the safety socket module in FIG. 6.

FIG. 7 is a side view of the safety socket module in FIG. 6. A cross-section of the push paddle 101 is configured substantially in a V-shape with an opening facing downward, a top end of the push paddle is a hinge point 103, one side edge of the push paddle is close to the jack 4, and the other side edge of the push paddle is covered with an insulating bush and abuts against the waterproof electrical connection switch 7. An angle between the two side edges of the push paddle 101 is set to match a width of the pin (distance b in FIG. 24), so that the push paddle 101 biases the movable contact piece 13 to contact with the static contact piece 14 only when a pin conforming to a size specified in a standard is inserted into the jack 4, and cannot bias the movable contact piece 13 to contact with the static contact piece 14 when a pin or other conductor not conforming to the size specified in the standard is inserted into the jack 4, and that the push paddle resets through the rebound of the waterproof electrical connection switch 7 when the pin is pulled out from the jack 4. The lengths of and the angle between the two side edges of the pushing paddle 101 and the shape of the bending portion of the clamping piece 102 are designed to ensure that when the pin is inserted into the jack 4, the pin is first tightly clamped by the pair of clamping pieces 102 and then pushes the push paddle 101, so as to prevent the generation of an electric arc.

Figure 8:
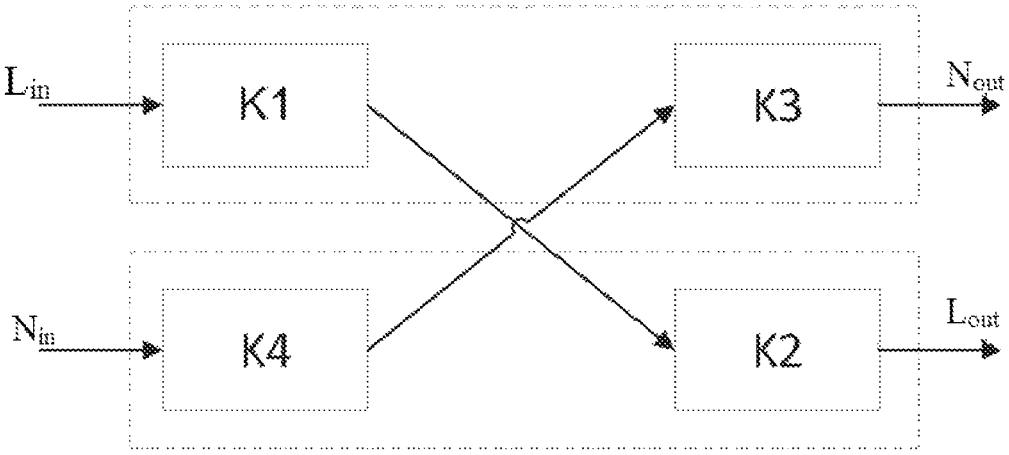
FIG. 8 is an electrical schematic diagram of the safety socket module in FIG. 1.

FIG. 8 is an electrical schematic diagram of the safety socket module in FIG. 1. A live wire ($L_{in}$) from a power supply is connected to a live wire ($L_{out}$) of a pin after being controlled in series by two waterproof electrical connection switches 7 (K1 and K2 in the figure). A neutral wire ($N_{in}$) from the power supply is connected to a neutral wire ($N_{out}$) of the pin after being controlled in series by two waterproof electrical connection switches 7 (K3 and K4 in the figure).

Figure 9:
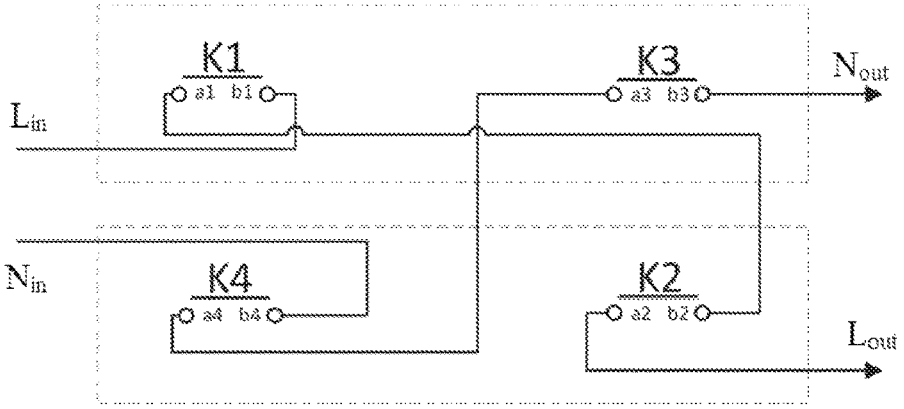
FIG. 9 is a circuit diagram of the safety socket module in FIG. 8.

FIG. 9 is a circuit diagram of the safety socket module in FIG. 1. A movable contact piece 13 (b1 in the figure) of a first waterproof electrical connection switch K1 in a live wire compartment 51 is connected to a live wire ($L_{in}$ in the figure) of a power supply. A static contact piece 14 (a1 in the figure) of the first waterproof electrical connection switch K1 is connected to a static contact piece 14 (a2 in the figure) of a second waterproof electrical connection switch K2 in a neutral wire compartment 52. A movable contact piece 13 (b2 in the figure) of the second waterproof electrical connection switch K2 is connected to a lock control member 10 in the live wire compartment 51 and then connected to a live wire ($L_{out}$ in the figure) of a pin (or may be connected to a lock control member 10 in the neutral wire compartment 52, where the lock control member 10 in the corresponding neutral wire compartment 52 is at the same potential as the live wire). In this embodiment, a movable contact piece 13 (b4 in the figure) of a fourth waterproof electrical connection switch K4 in the neutral wire compartment 52 is connected to a neutral wire ($N_{in}$ in the figure) of the power supply. A static contact piece 14 (a4 in the figure) of the fourth waterproof electrical connection switch K4 is connected to a movable contact piece 13 (b3 in the figure) of a third waterproof electrical connection switch K3 in the live wire compartment 51. A static contact piece 14 (a3 in the figure) of the third waterproof electrical connection switch K3 is connected to the lock control member 10 in the neutral wire compartment 52 and then connected to a neutral wire ($N_{out}$ in the figure) of the pin (or may be connected to the lock control member 10 in the live wire compartment 51, where the lock control member 10 in the corresponding live wire compartment 51 is at the same potential as the neutral wire). It should be noted that in this embodiment, the connecting wires of the movable contact piece and the static contact piece in the same waterproof electrical connection switch may be interchangeable (for example, a1 and b1 are interchangeable), and the selection of the waterproof electrical connection switch may also be changed, as long as one circuit includes the waterproof electrical connection switches controlled by the lock control members in two different compartments, for example, K1 and K4 are connected to each other and K3 and K2 are connected to each other. In this way, it is ensured that only when pins satisfying the standard are inserted into two jacks at the same time, the live wire circuit can be connected to the neutral wire circuit.

Figure 10:
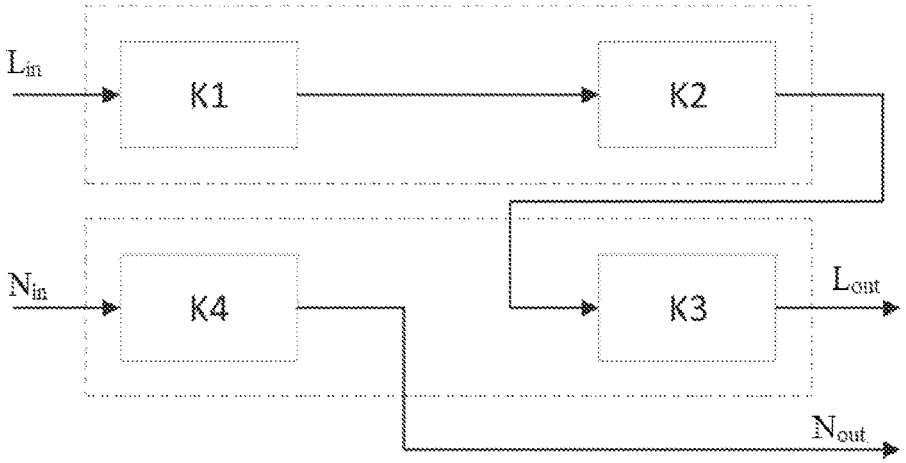
FIG. 10 is an electrical schematic diagram of a safety socket module according to another embodiment of the present disclosure.

FIG. 10 is an electrical schematic diagram of a safety socket module according to another embodiment of the present disclosure. The embodiment in FIG. 10 differs from the embodiment in FIG. 8 in that: a live wire ($L_{in}$) from a power supply is connected to a live wire ($L_{out}$) of a pin after being controlled in series by three waterproof electrical connection switches 7 (K1, K2, and K3 in the figure). A neutral wire ($N_{in}$) from the power supply is connected to a neutral wire ($N_{out}$) of a pin after being controlled by one waterproof electrical connection switch 7 (K4 in the figure). In this way, it is ensured that only when the pins satisfying the standard are inserted into two jacks at the same time, the three waterproof electrical connection switches of the live wire circuit can be switched on, so as to close the live wire circuit.

Figure 11:
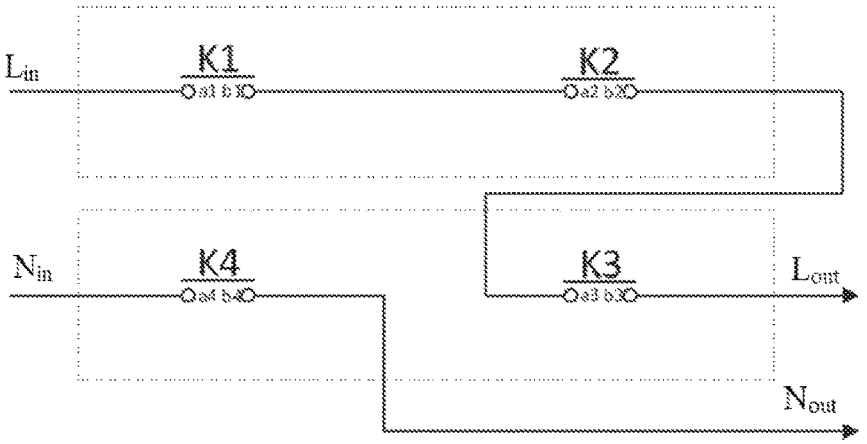
FIG. 11 is a circuit diagram of the safety socket module in FIG. 10.

FIG. 11 is a circuit diagram of the safety socket module in FIG. 10. A static contact piece 14 (a1 in the figure) of a first waterproof electrical connection switch K1 in a live wire compartment 51 is connected to a live wire ($L_{in}$ in the figure) of a power supply. A movable contact piece 13 (b1 in the figure) of the first waterproof electrical connection switch K1 is connected to a static contact piece 14 (a2 in the figure) of a second waterproof electrical connection switch K2 in the live wire compartment 51. A movable contact piece 13 (b2 in the figure) of the second waterproof electrical connection switch K2 is connected to a static contact piece 14 (a3 in the figure) of a third waterproof electrical connection switch K3 in a neutral wire compartment 52. A movable contact piece 13 (b3 in the figure) of the third waterproof electrical connection switch K3 is connected to a lock control member 10 in the live wire compartment 51 and then connected to a live wire ($L_{out}$ in the figure) of the pin. In this embodiment, a static contact piece 14 (a4 in the figure) of a fourth waterproof electrical connection switch K4 in the neutral wire compartment 52 is connected to a neutral wire ($N_{in}$ in the figure) of the power supply. A movable contact piece 13 (b4 in the figure) of the fourth waterproof electrical connection switch K4 is connected to a lock control member 10 in the neutral wire compartment 52 and then connected to a neutral wire ($N_{out}$ in the figure) of the pin. It should be noted that other connection sequences also fall within the protection scope of the present disclosure.

It can be seen from the descriptions of FIG. 9 and FIG. 11 that in the present disclosure, for a 2-pin socket module, the closing or opening of the circuit is controlled through a plurality of waterproof electrical connection switches, different numbers of waterproof electrical connection switches are selected depending on different situations, and particularly, the closing of the live wire circuit is controlled preferentially by using at least two waterproof electrical connection switches controlled by lock control members in different compartments, so as to ensure that the live wire circuit can be closed only when pins satisfying the standard are inserted into two jacks at the same time.

Figure 12:
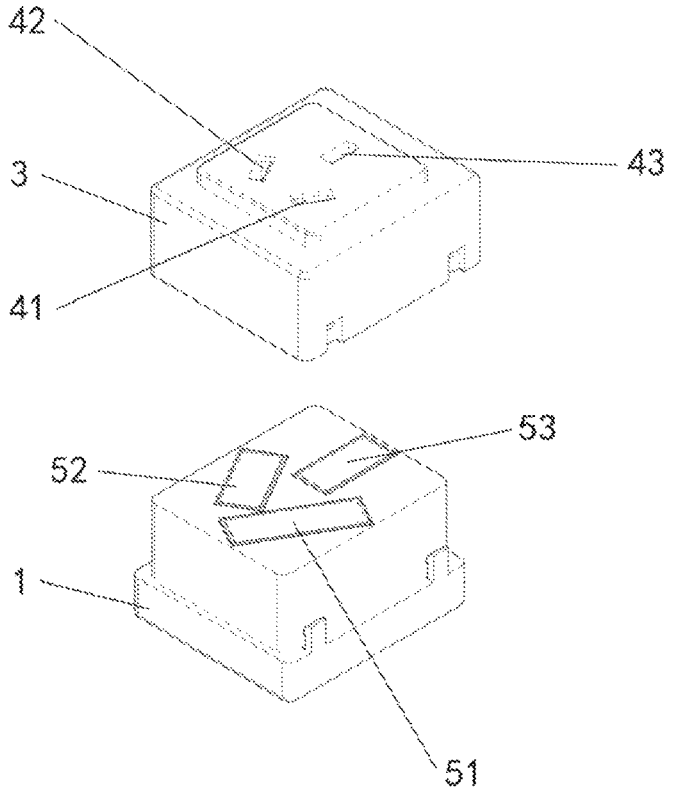
FIG. 12 is a three-dimensional diagram of a safety socket module according to another embodiment of the present disclosure.

FIG. 12 is a three-dimensional diagram of a safety socket module according to another embodiment of the present disclosure. The embodiment in FIG. 12 differs from the embodiment in FIG. 1 in that: the upper cover 3 is provided with a live wire jack 41 corresponding to a live wire pin of the plug of the electric appliance, a neutral wire jack 42 corresponding to a neutral wire pin of the plug of the electric appliance, and a ground wire jack 43 corresponding to a ground wire pin of the plug of the electric appliance. The safety socket module includes a live wire compartment 51 arranged below the live wire jack in the shell 1, a neutral wire compartment 52 arranged below the neutral wire jack in the shell 1, and a ground wire compartment 53 arranged below the ground wire jack in the shell 1.

Figure 13:
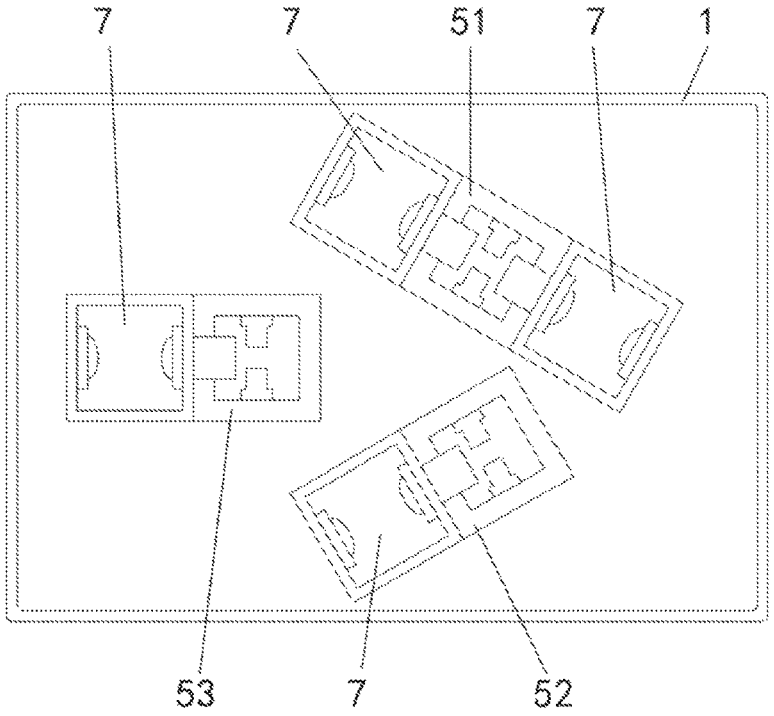
FIG. 13 is a top view of the safety socket module in FIG. 12.

FIG. 13 is a top view of the safety socket module in FIG. 12. A total of four waterproof electrical connection switches 7 are arranged in the live wire compartment 51, the neutral wire compartment 52, and the ground wire compartment 53 to form a protection circuit controlled by four switches. Limited by the volume of the internal space of the safety socket module, two of the four waterproof electrical connection switches 7 may be arranged in the live wire compartment 51, and one arranged in each of the neutral wire compartment 52 and the ground wire compartment 53; or two may be arranged in the neutral wire compartment 52, and one arranged in each of the live wire compartment 51 and the ground wire compartment 53; or two may be arranged in the ground wire compartment 53, and one arranged in each of the live wire compartment 51 and the neutral wire compartment 52.

Figure 14:
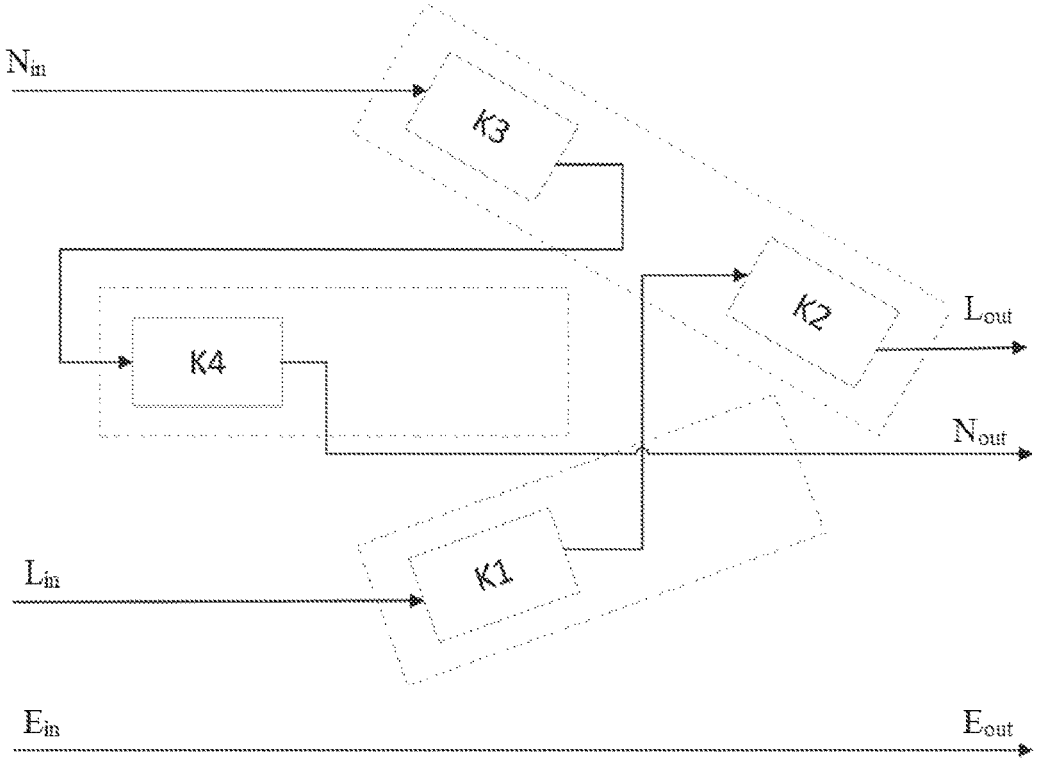
FIG. 14 is an electrical schematic diagram of the safety socket module in FIG. 12.

FIG. 14 is an electrical schematic diagram of the safety socket module in FIG. 12. A live wire ($L_{in}$) from a power supply is connected to a lock control member 10 ($L_{out}$) in a live wire compartment 51 after being controlled in series by two waterproof electrical connection switches 7 (K1 and K2 in the figure). A neutral wire ($N_{in}$) from the power supply is connected to a lock control member 10 ($N_{out}$) in a neutral wire compartment 52 after being controlled by two waterproof electrical connection switches 7 (K3 and K4 in the figure). A ground wire ($E_{in}$) from the power supply is directly connected to a lock control member 10 ($E_{out}$) in a ground wire compartment 53.

As can be seen from the description of FIG. 14, although the waterproof electrical connection switches 7 are respectively distributed in the compartments in the present disclosure, the waterproof electrical connection switch may not participate in the control of the circuit of the corresponding compartment. For example, the waterproof electrical connection switch 7 in the ground wire compartment 53 only occupies space in the ground wire compartment 53, and actually participates in the control of the neutral wire circuit.

Figure 15:
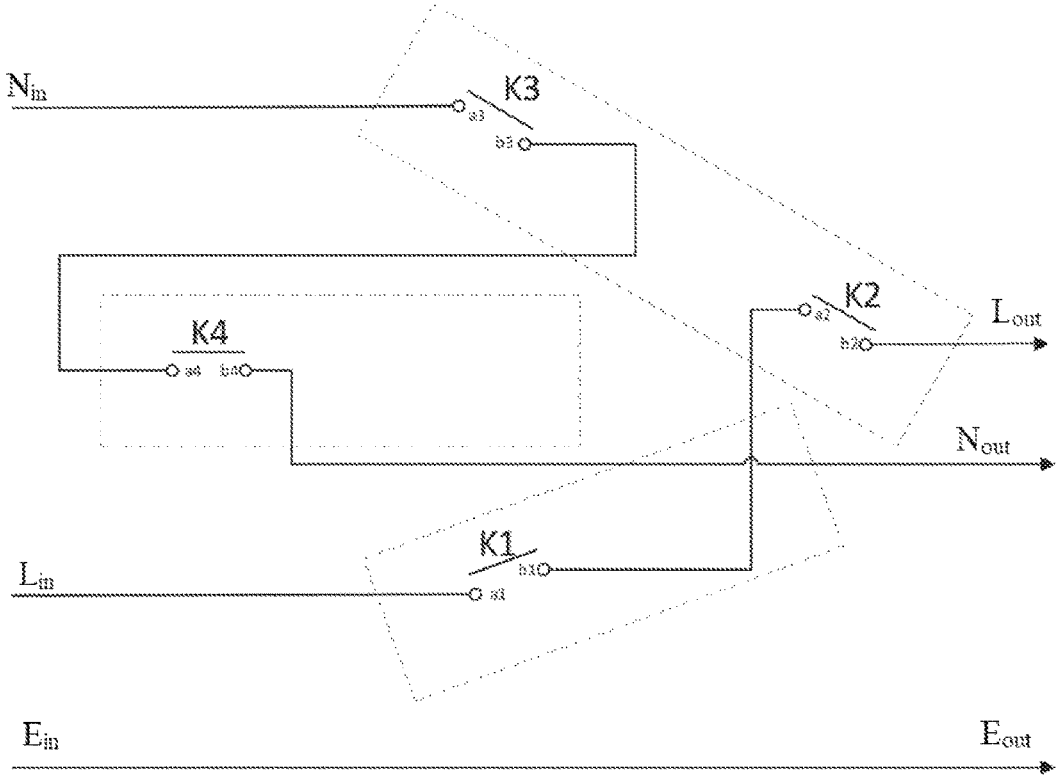
FIG. 15 is a circuit diagram of the safety socket module in FIG. 12.

FIG. 15 is a circuit diagram of the safety socket module in FIG. 12. In this embodiment, a static contact piece 14 (a1 in the figure) of a first waterproof electrical connection switch K1 in a neutral wire compartment 52 is connected to a live wire ($L_{in}$ in the figure) of a power supply. A movable contact piece 13 (b1 in the figure) of the first waterproof electrical connection switch K1 is connected to a static contact piece 14 (a2 in the figure) of a second waterproof electrical connection switch K2 in a live wire compartment 51. A movable contact piece 13 (b2 in the figure) of the second waterproof electrical connection switch K2 is connected to a lock control member 10 in a live wire compartment 51 and then connected to a live wire ($L_{out}$ in the figure) of a pin. In this embodiment, a static contact piece 14 (a3 in the figure) of a third waterproof electrical connection switch K3 in the live wire compartment 51 is connected to a neutral wire ($N_{in}$ in the figure) of the power supply; A movable contact piece 13 (b3 in the figure) of the third waterproof electrical connection switch K3 is connected to a static contact piece 14 (a4 in the figure) of a fourth waterproof electrical connection switch K4 in a ground wire compartment 53. A movable contact piece 13 (b4 in the figure) of the fourth waterproof electrical connection switch K4 is connected to a lock control member 10 in a neutral wire compartment 52 and then connected to a neutral wire ($N_{out}$ in the figure) of the pin. In this embodiment, a ground wire ($E_{in}$ in the figure) of the power supply is directly connected to a ground wire ($E_{out}$ in the figure) of the pin through a lock control member 10 in the ground wire compartment 53. It should be noted that other connection sequences also fall within the protection scope of the present disclosure.

Figure 16:
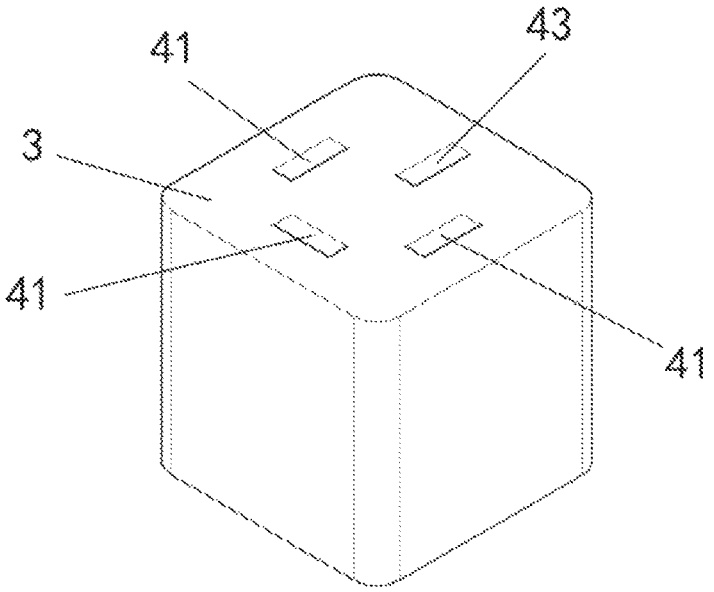
FIG. 16 is a three-dimensional diagram of a safety socket module according to another embodiment of the present disclosure.

FIG. 16 is a three-dimensional diagram of a safety socket module according to a fourth embodiment of the present disclosure. The embodiment in FIG. 16 differs from the embodiment in FIG. 1 in that: the upper cover 3 is provided with three live wire jacks 41 corresponding to live wire pins of the plug of the electric appliance and a ground wire jack 43 corresponding to a ground wire pin of the plug of the electric appliance.

Figure 17:
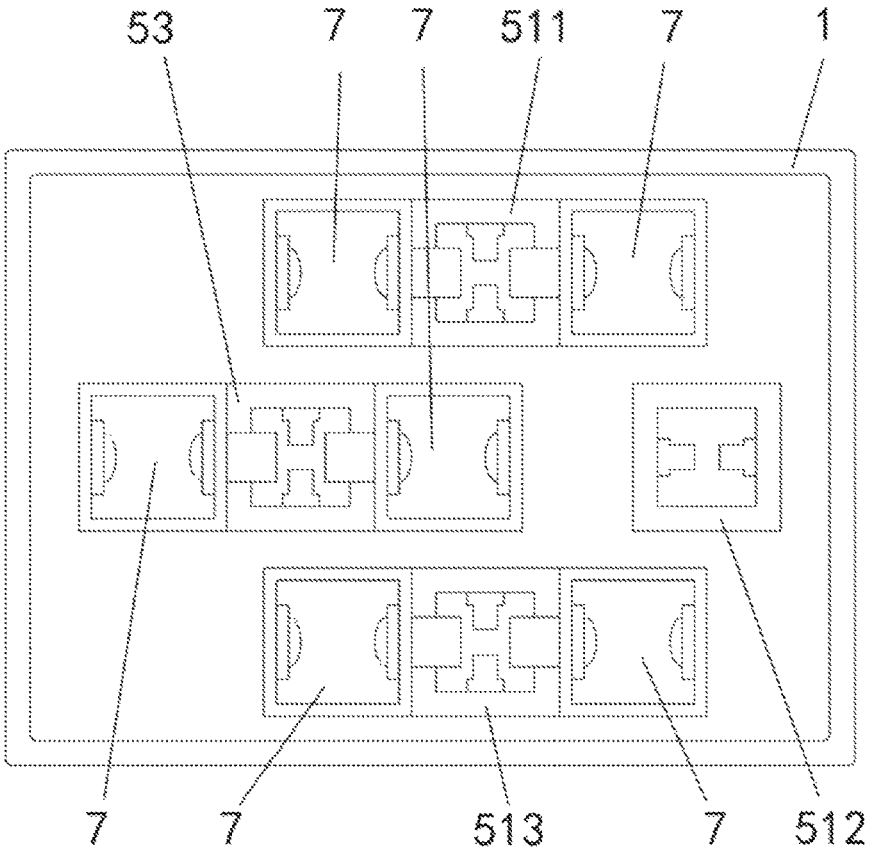
FIG. 17 is a top view of the safety socket module in FIG. 16.

FIG. 17 is a top view of the safety socket module in FIG. 16. The safety socket module includes: a first live wire compartment 511, a second live wire compartment 512 and a third live wire compartment 513 which are respectively arranged below the three live wire jacks in the shell 1; and a ground wire compartment 53 arranged below the ground wire jack in the shell 1. Two waterproof electrical connection switches 7 are arranged in each of the first live wire compartment 511, the ground wire compartment 53, and the third live wire compartment 513 to form a protection circuit controlled by six switches.

Figure 18:
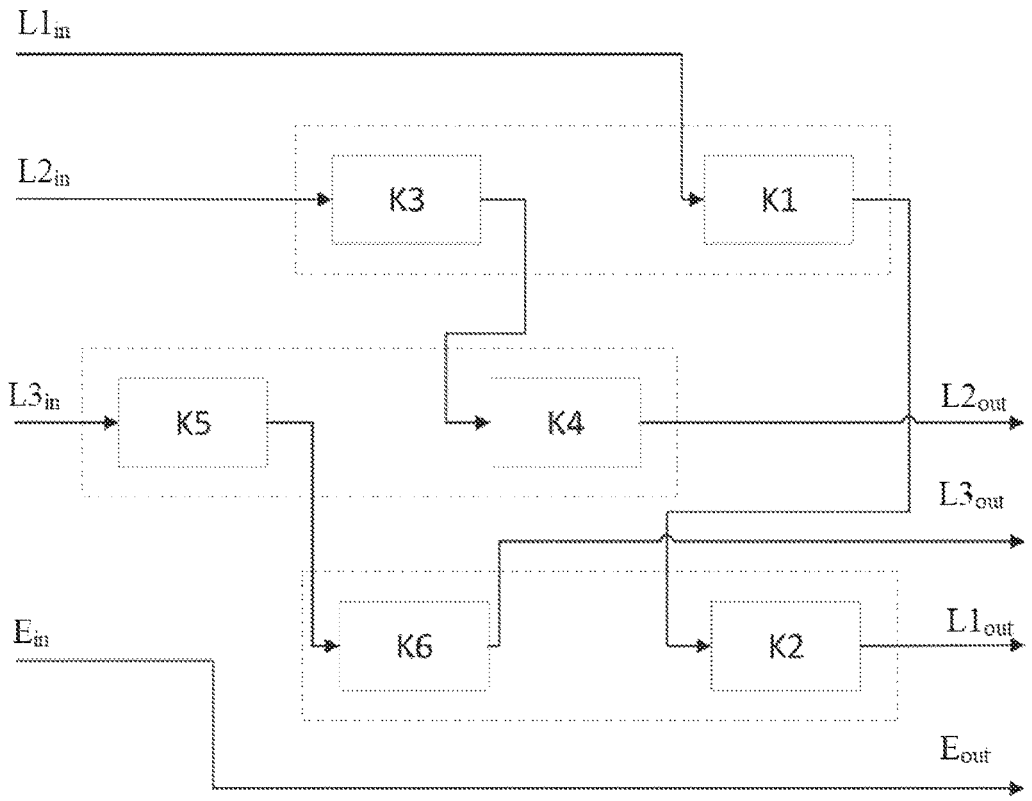
FIG. 18 is an electrical schematic diagram of the safety socket module in FIG. 16.

FIG. 18 is an electrical schematic diagram of the safety socket module in FIG. 16. A first live wire ($L1_{in}$) from a power supply is connected to a first live wire ($L1_{out}$) of a pin after being controlled in series by two waterproof electrical connection switches 7 (K1 and K2 in the figure). A second live wire ($L2_{in}$) from the power supply is connected to a second live wire ($L2_{out}$) of the pin after being controlled in series by two waterproof electrical connection switches 7 (K3 and K4 in the figure). A third live wire ($L3_{in}$) from the power supply is connected to a third live wire ($L3_{out}$) of the pin after being controlled in series by two waterproof electrical connection switches 7 (K5 and K6 in the figure). A ground wire ($E_{in}$) from the power supply is directly connected to a ground wire ($E_{out}$) of the pin.

Figure 19:
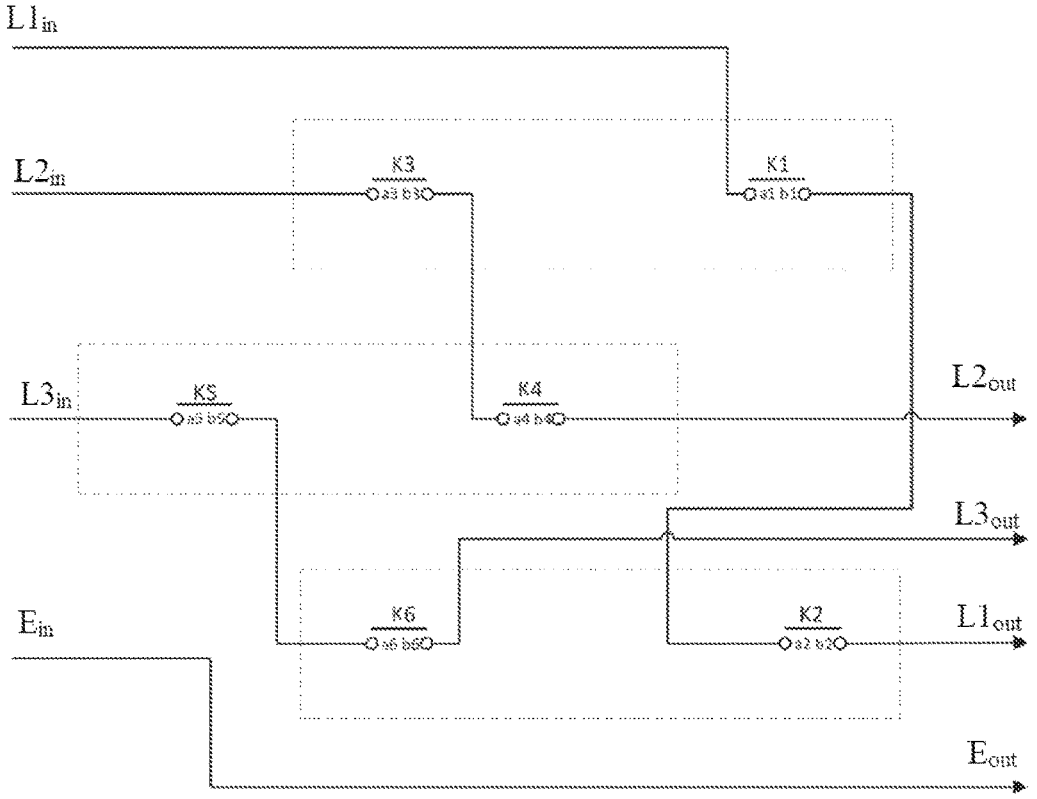
FIG. 19 is a circuit diagram of the safety socket module in FIG. 16.

FIG. 19 is a circuit diagram of the safety socket module in FIG. 16. A static contact piece 14 (a1 in the figure) of a first waterproof electrical connection switch K1 in a first live wire compartment 511 is connected to a first live wire ($L1_{in}$ in the figure) of a power supply. A movable contact piece 13 (b1 in the figure) of the first waterproof electrical connection switch K1 is connected to a static contact piece 14 (a2 in the figure) of a second waterproof electrical connection switch K2 in a third live wire compartment 513. A movable contact piece 13 (b2 in the figure) of the second waterproof electrical connection switch K2 is connected to a lock control member 10 in the first live wire compartment 511 and then connected to a first live wire ($L1_{out}$ in the figure) of a pin. In this embodiment, a static contact piece 14 (a3 in the figure) of a third waterproof electrical connection switch K3 in the first live wire compartment 511 is connected to a second live wire ($L2_{in}$ in the figure) of the power supply. A movable contact piece 13 (b3 in the figure) of the third waterproof electrical connection switch K3 is connected to a static contact piece 14 (a4 in the figure) of a fourth waterproof electrical connection switch K4 in the second live wire compartment 512. A movable contact piece 13 (b4 in the figure) of the fourth waterproof electrical connection switch K4 is connected to a lock control member 10 in the second live wire compartment 512 and then connected to a second live wire ($L2_{out}$ in the figure) of the pin. In this embodiment, a static contact piece 14 (a5 in the figure) of a fifth waterproof electrical connection switch K5 in the second live wire compartment 512 is connected to a third live wire ($L3_{in}$ in the figure) of the power supply. A movable contact piece 13 (b5 in the figure) of the fifth waterproof electrical connection switch K5 is connected to a static contact piece 14 (a6 in the figure) of a sixth waterproof electrical connection switch K6 in the third live wire compartment 513. A movable contact piece 13 (b6 in the figure) of the sixth waterproof electrical connection switch K6 is connected to a lock control member 10 in the third live wire compartment 513 and then connected to a third live wire ($L3_{out}$ in the figure) of the pin. In this embodiment, a ground wire ($E_{in}$ in the figure) of the power supply is directly connected to a ground wire ($E_{out}$ in the figure) of the pin through a lock control member 10 in a ground wire compartment 53. It should be noted that other connection sequences also fall within the protection scope of the present disclosure.

Figure 20:
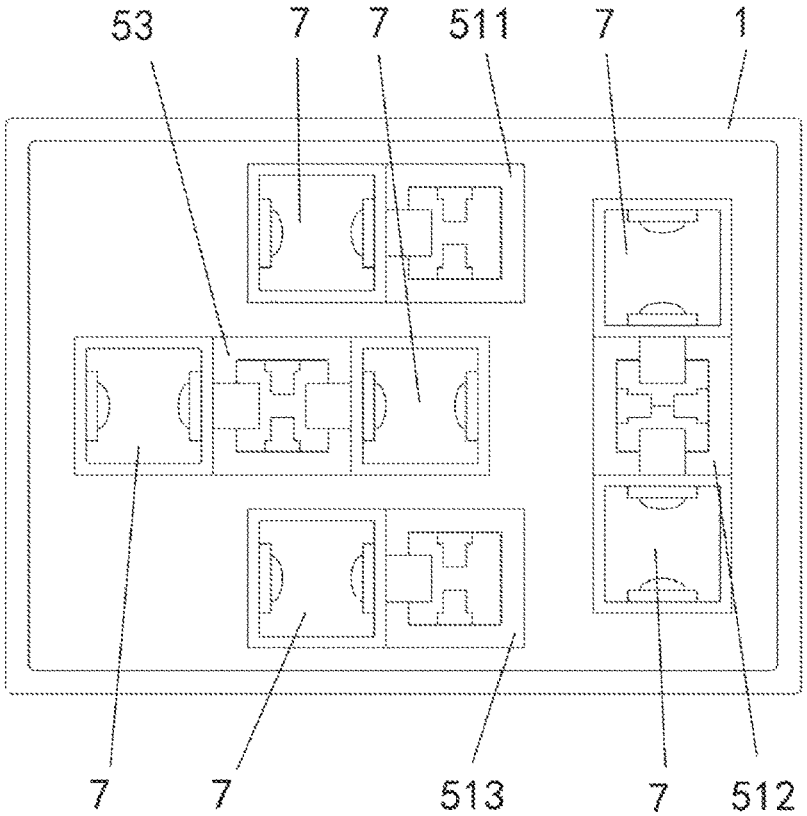
FIG. 20 is a top view of a safety socket module according to another embodiment of the present disclosure.

FIG. 20 is a top view of a safety socket module according to another embodiment of the present disclosure. The embodiment in FIG. 20 differs from the embodiment in FIG. 16 in that: one waterproof electrical connection switch 7 is arranged in each of the first live wire compartment 511 and the third live wire compartment 513, and two waterproof electrical connection switches 7 are arranged in each of the second live wire compartment 512 and the ground wire compartment 53, to form a protection circuit controlled by six switches.

Figure 21:
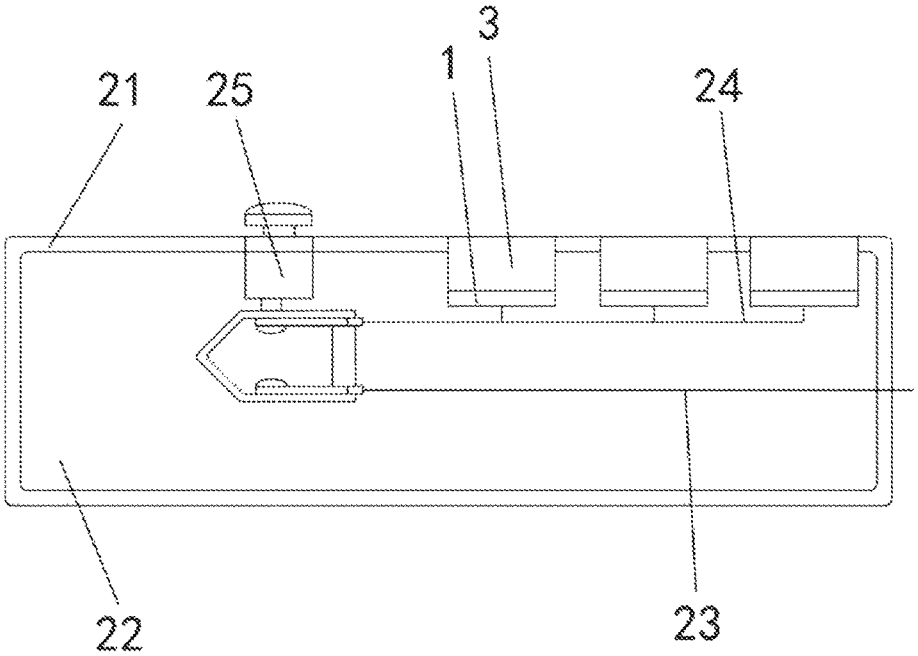
FIG. 21 is a cross-sectional view of a power strip according to the present disclosure.

FIG. 21 is a cross-sectional view of a power strip according to the present disclosure. The power strip includes: a power strip shell 21; an external power cable 23, connected externally into the power strip shell; and an internal power cable 24, arranged in the power strip shell. One or more safety socket modules are embedded in the power strip shell 21. The one or more safety socket modules in the power strip may have the same or different numbers of jacks. It should be noted that, for safety reasons, an industrial 4-pin safety socket module is not allowed to be arranged in the same power strip as 2-pin and 3-pin safety socket modules. The power strip shell 21 is configured to expose the upper cover 3 of the safety socket module. The safety socket modules are connected in parallel to the internal power cable 24. The external power cable 23 is connected to the internal power cable 24 through a mechanical switch 25.

Figure 22:
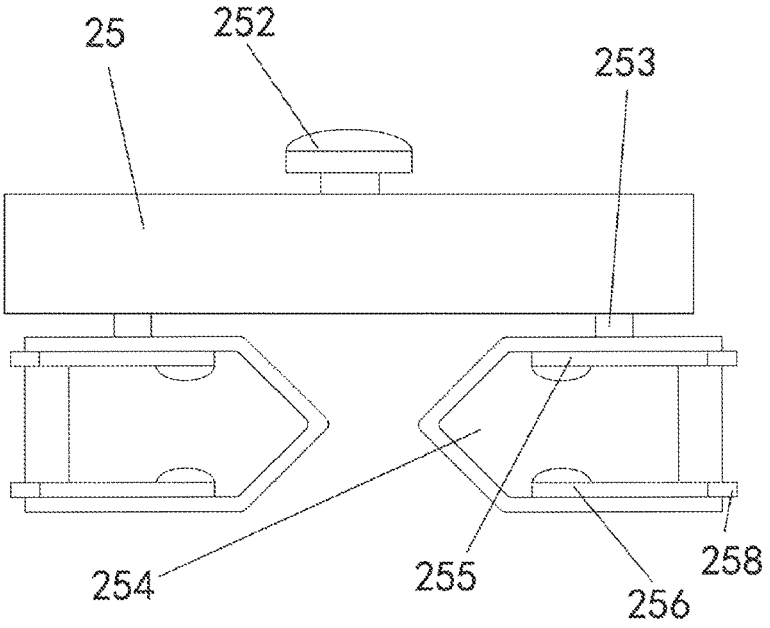
FIG. 22 is a cross-sectional view of a mechanical switch of the power strip in FIG. 21.
Figure 26:
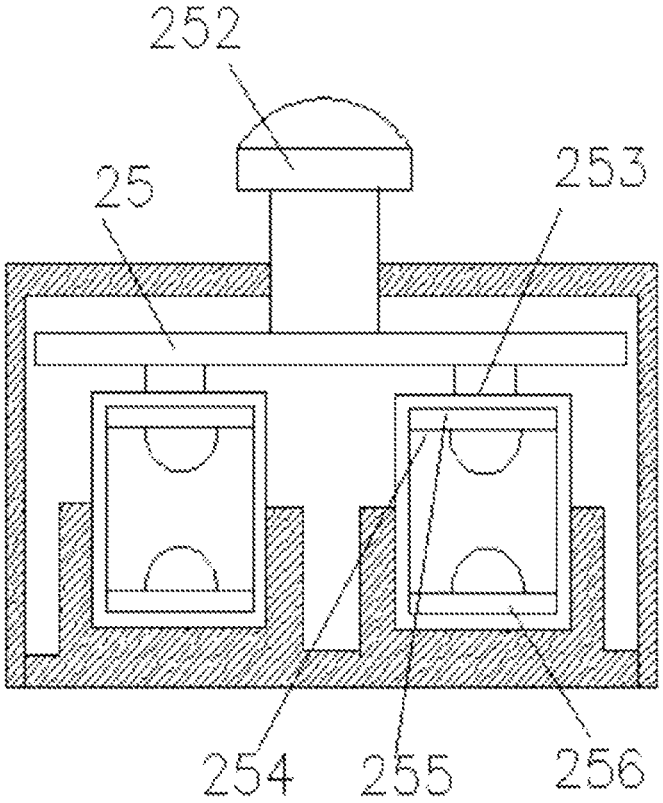
FIG. 26 is a separate view showing parts of the mechanical switch in FIG. 22.
Figure 27:
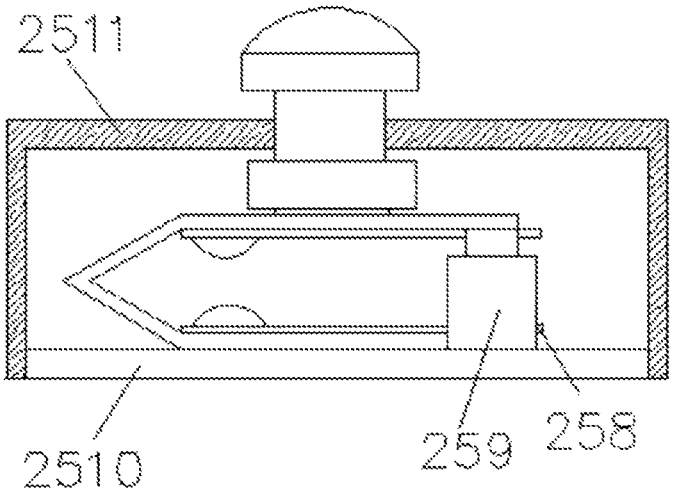
FIG. 27 is a side view of FIG. 26.

FIG. 22 is a cross-sectional view of a mechanical switch of the power strip in FIG. 21. The mechanical switch 25 includes: a switch button 252 having a depressed position and a raised position; a push member 253, connected to the switch button 252; and a switch waterproof capsule 254, abutting against the push member 253. The switch waterproof capsule 254 includes a switch movable contact piece 255 and a switch static contact piece 256 opposite to each other therein. The switch movable contact piece 255 is connected to one of the external power cable 23 and the internal power cable 24, and the switch static contact piece 256 is connected to the other of the external power cable 23 and the internal power cable 24. The switch movable contact piece 255 is configured to contact with the switch static contact piece 256 to connect the external power cable 23 to the internal power cable 24 through biasing of the push member 253 when the switch button 252 is in the depressed position, and to move away from the switch static contact piece 256 to disconnect the external power cable 23 from the internal power cable 24 through retraction of the push member 253 when the switch button 252 is in the raised position. Since most of neutral wires of power grids carry electricity in real life, two mechanical switches are required to control the connection and disconnection of the live wire and the neutral wire respectively during plugging and unplugging in water. In this embodiment, the mechanical switch 25 includes two switch waterproof capsules 254. The switch movable contact piece 255 and the switch static contact piece 256 of one of the switch waterproof capsules 254 are respectively connected to a live wire of the external power cable 23 and a live wire of the internal power cable 24. The switch movable contact piece 255 and the switch static contact piece 256 of the other of the switch waterproof capsules 254 are respectively connected to a neutral wire of the external power cable 23 and a neutral wire of the internal power cable 24. Similar to the conductive connector 8, a switch conductive connector 258 is configured to extend through the switch waterproof capsule 254 to provide an electrical connection of the switch movable contact piece 255 and the switch static contact piece 256 to other components. In a preferred solution, the mechanical switch further includes a mechanical switch upper cover 2511, a mechanical switch bottom cover 2510, and a switch waterproof capsule fixing plate 259, as shown in FIG. 26 and FIG. 27. The switch conductive connector 258 is a conductor covered with an insulating layer (insulated wire), and is connected to the contact pieces in the switch waterproof capsule 254, and is injection molded with an insulating material on the bottom of the switch waterproof capsule, to provide a waterproof function for the electrical connection part.

Figure 23:
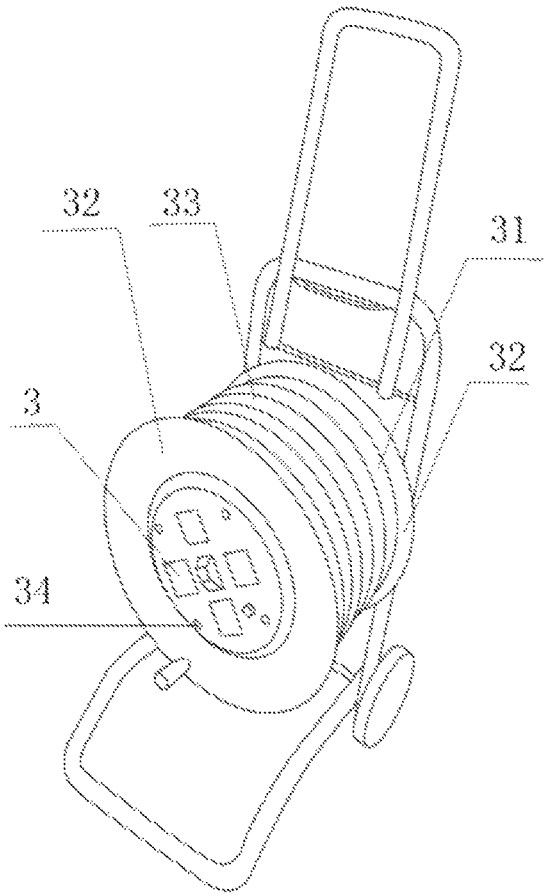
FIG. 23 is a three-dimensional diagram of a mobile cable reel according to the present disclosure.

FIG. 23 is a three-dimensional diagram of a mobile cable reel according to the present disclosure. The mobile cable reel includes: a drum 31; two baffles 32, respectively arranged on two opposing sides of the drum 31; a cable reel power cable 33, coiled on an outer periphery of the drum 31; a plurality of safety socket modules (the upper covers 3 of which are exposed in the figure) arranged on the baffles 32; and drain openings 34, arranged on the baffles (32) and corresponding to the safety socket modules.

In an embodiment, as shown in FIG. 5, this embodiment separately provides a waterproof electrical connection switch, including: an isolated waterproof chamber, and a movable contact piece 13 and a static contact piece 14 arranged opposite to each other in the isolated waterproof chamber. The isolated waterproof chamber is configured as a fully sealed structure, and has at least one flexible surface which is elastically deformable. The movable contact piece 13 is configured to deform and contact with the static contact piece 14 when an external force is applied to the flexible surface, so as to switch on the waterproof electrical connection switch. When the external force is released, the movable contact piece 13 resets and moves away from the static contact piece 14, so as to switch off the waterproof electrical connection switch.

In a solution, as shown in FIG. 4 and FIG. 7, the waterproof electrical connection switch as a whole is installed in the compartment 5 of the socket as an independent electrical connection switch. The flexible surface is configured in such a manner that when a pin with a standard width or with a standard width and thickness is inserted into the jack, the pin acts on the lock control member 10 and biases the flexible surface to produce a standard deformation. The movable contact piece 13 is configured to move laterally or outward by a standard deformation distance to bias the static contact piece 14 when the flexible surface is deformed; and move away from the static contact piece 14 to switch off the waterproof electrical connection switch when the flexible surface recovers from the standard deformation. The lock control member 10 is configured to undergo a standard deformation when a standard pin is inserted into the jack, and produce a lateral or outward standard movement distance to bias the waterproof electrical connection switch, so as to switch on the switch.

In a solution, as shown in FIG. 4 and FIG. 7, the isolated waterproof chamber is a waterproof capsule 12, which includes a capsule base 15 and a waterproof rubber sleeve 16 fixed to the capsule base 15. The movable contact piece 13 and the static contact piece 14 are arranged inside the waterproof rubber sleeve and fixed to the capsule base 15. The movable contact piece 13 and the static contact piece 14 are respectively provided with contacts 9. The movable contact piece 13 and the static contact piece 14 are configured to contact with each other through the contacts 9. In a solution, as shown in FIG. 5, an insulating elastic piece 17 is arranged between the movable contact piece 13 and the static contact piece 14 to assist and correct the deformation and rebound of the movable contact piece 13 and the static contact piece 14. In a solution, as shown in FIG. 4 and FIG. 7, the waterproof electrical connection switch includes conductive connectors 8. The movable contact piece 13 or the static contact piece 14 in the isolated waterproof chamber is integrally formed with the corresponding conductive connector 8; or the movable contact piece 13 or the static contact piece 14 in the isolated waterproof chamber is electrically connected to the corresponding independent conductive connector 8. In a solution, the conductive connector 8 is an insulated wire, the movable contact piece 13 or the static contact piece 14 in the isolated waterproof chamber is connected to one end of the corresponding insulated wire, the connection part is subjected to injection molding process to form a capsule base 15, and another end of the insulated wire runs through the capsule base 15. In a solution, the conductive connector 8 of the waterproof electrical connection switch is configured to electrically connect to a lock control member 10, which is used for receiving insertion of a pin, in the same compartment 5, so that when the waterproof electrical connection switch is switched on, the circuit of the compartment 5 is closed; and/or the conductive connecting piece 8 of the waterproof electrical connection switch is configured to electrically connect to a lock control member 10, which is used for receiving insertion of a pin, in another compartment 5, so that when the waterproof electrical connection switch is switched on, the circuit of the another compartment 5 is closed. In a solution, a connection part of the waterproof electrical connection switch connected to a conductor in the bottom of the compartment 5 and an exposed part of the conductor are covered with a waterproof insulating material for waterproof treatment.

In a solution, as shown in FIGS. 21-22 and FIGS. 26-27, based on the above-mentioned waterproof electrical connection switch, a waterproof mechanical switch is provided, including: a switch button (252) having a depressed position and a raised position, a push member (253), connected to the switch button, and a switch waterproof capsule (254), abutting against the push member, the switch waterproof capsule includes a switch movable contact piece (255) and a switch static contact piece (256) opposite to each other therein; the switch movable contact piece is connected to one of the external power cable and the internal power cable, and the switch static contact piece is connected to the other of the external power cable and the internal power cable; and the switch movable contact piece is configured to contact with the switch static contact piece to connect the external power cable to the internal power cable through biasing of the push member when the switch button is in the depressed position, and to move away from the switch static contact piece to disconnect the external power cable from the internal power cable through a retraction of the push member when the switch button is in the raised position. In a solution, the mechanical switch includes two switch waterproof capsules; the switch movable contact piece and the switch static contact piece of one of the switch waterproof capsules are respectively connected to a live wire of the external power cable and a live wire of the internal power cable; the switch movable contact piece and the switch static contact piece of the other of the switch waterproof capsules are respectively connected to a neutral wire of the external power cable and a neutral wire of the internal power cable; and each of the switch waterproof capsules controls closing and opening of a circuit.

The waterproof electrical connection switches in this embodiment may be supplemented by corresponding structures in other embodiments, and the structures such as the lock control members in this embodiment may be supplemented or replaced by corresponding structures in other embodiments.

In an embodiment, a lock control member is separately provided, which is configured to undergo a standard deformation of the lock control member when a standard pin is inserted into the jack, and produce a lateral or outward standard movement distance to bias the waterproof electrical connection switch, so as to switch on the switch. The lock control member can produce a standard deformation and move laterally or outward by a standard distance, indicating that the conductor inserted into the jack is most likely a standard pin, or otherwise the standard lateral or outward movement distance cannot be achieved. Compared with solutions where the lock control member is not used and an conductor is inserted to directly act on the electrical connection switch, the solution of this embodiment has higher requirements for the standardization of the conductor, and there is an extremely low possibility that the waterproof electrical connection switch will be switched on by a pin which is not from a plug. Therefore, the solution of connecting a pin to a power supply through a lock control member that causes a standard movement can achieve the better electric-shock-proof performance.

In a solution, when the pin is pulled out from the jack, the pin is disengaged from the lock control member, and the lock control mechanism does not maintain deformation any longer and moves away from the waterproof electrical connection switch, to reset the waterproof electrical connection switch. In a solution, the standard pin is a pin of a plug with a standard width or a standard thickness or with a standard width and a standard width thickness.

In a solution, as shown in FIG. 4, the lock control member is made of a conductor material and includes a push paddle 101 arranged perpendicularly to a bottom surface of the compartment 5 and a fixing component, and the fixing component includes a pair of clamping pieces 102; a plane where the push paddle 101 lies is perpendicular to a plane where the fixing component lies; and the push paddle 101 includes a bend near an end portion thereof, the bend includes a first bending portion 104 abutting against the waterproof electrical connection switch and a second bending portion 105 facing toward the pin, and a spacing of the push paddle 101 is set to match a width of the pin, so that the push paddle 101 biases the movable contact piece 13 to contact with the static contact piece 14 only when a pin conforming to a size specified in a standard is inserted into the jack, and cannot bias the movable contact piece to contact with the static contact piece 14 when a pin or other conductor not conforming to the size specified in the standard is inserted into the jack, and that the push paddle resets when the pin is pulled out from the jack; and as shown in FIG. 25, the two clamping pieces 102 are opposite to each other, each of the clamping pieces 102 is provided near an end portion thereof with a bending portion 106 facing toward the pin, and a distance between the two clamping pieces 102 is set to match a thickness of the pin, so that the pin is tightly clamped by the bending portions 106 of the clamping pieces 102 when being inserted into the jack, and the clamping pieces reset when the pin is pulled out from the jack. In a solution, the bending portion of each of the clamping pieces 102 is closer to the jack than the bend of the push paddle 101 is, to ensure that when the pin is inserted into the jack, the pin is first tightly clamped by the pair of clamping pieces 102 and then pushes the push paddle 101.

In a solution, as shown in FIG. 7, the lock control member is made of a conductor material and includes a split-molded push paddle 101 arranged on the compartment 5 and a pair of clamping pieces 102 arranged perpendicularly to a bottom surface of the compartment 5. A cross-section of the push paddle 101 is configured substantially in a V-shape with an opening facing downward, a top end of the push paddle is a hinge point 103, one side edge of the push paddle is close to the jack, and the other side edge of the push paddle is covered with an insulating bush and abuts against the waterproof electrical connection switch. An angle between the two side edges of the push paddle 101 is set to match a width of the pin, so that the push paddle 101 biases the movable contact piece 13 to contact with the static contact piece 14 only when a pin conforming to a size specified in a standard is inserted into the jack, and cannot bias the movable contact piece 13 to contact with the static contact piece 14 when a pin or other conductor not conforming to the size specified in the standard is inserted into the jack, and that the push paddle resets when the pin is pulled out from the jack. In addition, as shown in FIG. 4, the two clamping pieces 102 are opposite to each other, each of the clamping pieces 102 is provided near an end portion thereof with a bending portion 106 facing toward the pin, and a distance between the two clamping pieces 102 is set to match a thickness of the pin, so that the pin is tightly clamped by the bending portions 106 of the clamping pieces 102 when being inserted into the jack, and the clamping pieces reset when the pin is pulled out from the jack. In a solution, the bending portion of each of the clamping pieces 102 is closer to the jack than the part of the push paddle 101 in contact with the pin is, to ensure that when the pin is inserted into the jack, the pin is first tightly clamped by the pair of clamping pieces 102 and then pushes the push paddle 101.

In a solution, the lock control members are respectively arranged in the compartments 5 and aligned with the jacks, the number of the compartments 5 corresponds to the number of the jacks, each of the compartments 5 is arranged in the shell and below a respective jack of the jacks, and an interior of each of the compartments 5 is accessible from an exterior of the shell through the respective jack.

The lock control members in this embodiment may be supplemented by corresponding structures in other embodiments, and the structures such as the waterproof electrical connection switches in this embodiment may be supplemented or replaced by corresponding structures in other embodiments.

In an embodiment, as shown in FIG. 13, a first 3-pin safety socket is provided, including: a shell 1; an upper cover 3, configured to cover the shell and provided with three jacks 4, where the upper cover is provided with a live wire jack corresponding to a live wire pin of a plug of an electric appliance, a neutral wire jack corresponding to a neutral wire pin of the plug of the electric appliance, and a ground wire jack corresponding to a ground wire pin of the plug of the electric appliance; compartments 5, where the number of the compartments corresponds to the number of the jacks, each of the compartments 5 is arranged in the shell 1 and below a respective jack of the jacks, an interior of each of the compartments 5 is accessible from an exterior of the shell 1 through the respective jack, and the compartments 5 include a live wire compartment 51 arranged below the live wire jack in the shell 1, a neutral wire compartment 52 arranged below the neutral wire jack in the shell, and a ground wire compartment 53 arranged below the ground wire jack in the shell; and waterproof electrical connection switches 7, arranged in the compartments as independent electrical connection switches and configured to control connection and disconnection of a circuit between a power supply and the plug of the electric appliance. Two waterproof electrical connection switches are arranged in the live wire compartment 51, one waterproof electrical connection switch is arranged in the neutral wire compartment 52, and one waterproof electrical connection switch is arranged in the ground wire compartment 53. The switch structure of the waterproof electrical connection switch is enclosed inside a sealed space formed by a waterproof material. When a pin is inserted into the jack of the compartment 5 where the waterproof electrical connection switch is located, the pin contacts with the waterproof electrical connection switch to close the switch structure. When all the waterproof electrical connection switches in the compartments 5 are closed, the electric appliance is connected to the power supply.

In this embodiment, a second 3-pin safety socket is also separately provided, including: a shell 1; an upper cover 3, configured to cover the shell and provided with three jacks 4, where the upper cover is provided with a live wire jack corresponding to a live wire pin of a plug of an electric appliance, a neutral wire jack corresponding to a neutral wire pin of the plug of the electric appliance, and a ground wire jack corresponding to a ground wire pin of the plug of the electric appliance; compartments 5, where the number of the compartments corresponds to the number of the jacks, each of the compartments 5 is arranged in the shell 1 and below a respective jack of the jacks, an interior of each of the compartments 5 is accessible from an exterior of the shell 1 through the respective jack, and the compartments 5 include a live wire compartment 51 arranged below the live wire jack in the shell 1, a neutral wire compartment 52 arranged below the neutral wire jack in the shell, and a ground wire compartment 53 arranged below the ground wire jack in the shell; and waterproof electrical connection switches 7, arranged in the compartments as independent electrical connection switches and configured to control connection and disconnection of a circuit between a power supply and the plug of the electric appliance. One waterproof electrical connection switch is arranged in the live wire compartment 51, two waterproof electrical connection switches are arranged in the neutral wire compartment 52, and one waterproof electrical connection switch is arranged in the ground wire compartment 53. The switch structure of the waterproof electrical connection switch is enclosed inside a sealed space formed by a waterproof material. When a pin is inserted into the jack of the compartment 5 where the waterproof electrical connection switch is located, the pin contacts with the waterproof electrical connection switch to close the switch structure. When all the waterproof electrical connection switches in the compartments 5 are closed, the electric appliance is connected to the power supply.

The waterproof electrical connection switches described in other embodiments can be used independently in the socket in this embodiment, and the waterproof electrical connection switch is closed by inserting pins of a plug into the jacks, so as to control the connection of the pins to the power supply. For the two types of 3-pin safety sockets in this embodiment, in a compartment, it is possible to insert a conductor to switch on one waterproof electrical connection switch. However, to switch on two waterproof electrical connection switches, conductors inserted into the jacks need to have a great similarity to a standard pin. In this way, there is an extremely low possibility that the two waterproof electrical connection switches will be switched on by pins which are not from the plug. Therefore, the solution of connecting pins to a power supply by switching on two waterproof electrical connection switches can achieve better electric-shock-proof performance. Therefore, if two waterproof electrical connection switches are arranged in each compartment, much higher electric-shock-proof performance will be achieved. However, limited by the constraints such as the arrangement of jacks and the jack spacing in 3-pin socket standards, two waterproof electrical connection switches are arranged in one of the live wire compartment or the neutral wire compartment, and one waterproof electrical connection switch is arranged in each of the remaining compartments, thereby improving the electric-shock-proof performance as much as possible while satisfying the standards.

In a solution, in order to overcome the defect that the connection of the live wire and the neutral wire to pins of the plug cannot be controlled by two switches while satisfying the standard, the following solution is further provided: a live wire of the power supply is connected to a lock control member in the live wire compartment 51, two waterproof electrical connection switches located in different compartments are connected in series between the live wire of the power supply and the lock control member in the live wire compartment 51, and the lock control member in the live wire compartment 51 is configured in such a manner that when a live wire pin is inserted into the live wire jack, the lock control member is connected to the live wire pin, and the live wire pin is connected to the live wire of the power supply through the waterproof electrical connection switches in two different compartments; and a neutral wire of the power supply is connected to a lock control member in the neutral wire compartment 52, two other waterproof electrical connection switches located in different compartments are connected in series between the neutral wire of the power supply and the lock control member in the neutral wire compartment 52, and the lock control member in the neutral wire compartment 52 is configured in such a manner that when a neutral wire pin is inserted into the neutral wire jack, the lock control member is connected to the neutral wire pin, and the neutral wire pin is connected to the neutral wire of the power supply through the waterproof electrical connection switches in two different compartments. In this solution, the connection of the live wire and the neutral wire that have high requirements for electric shock protection to pins is controlled using two compartments and two switches. The socket has the above-mentioned advantage of improved electric-shock-proof performance through the arrangement of two switches in one of the three compartments, and the live wire or the neutral wire of the power supply can be connected to the corresponding pin only when conductors are inserted into the jacks of at least two compartments at the same time, thereby further improving the electric-shock-proof performance of the socket.

In a solution, for the first type of 3-pin safety socket, a specific internal circuit structure is provided. This solution improves the electric-shock-proof performance while satisfying a 3-pin socket standard. The live wire of the power supply is connected to one waterproof electrical connection switch in the live wire compartment 51 and is connected to the lock control member in the live wire compartment 51, one waterproof electrical connection switch in the live wire compartment 51 is connected in series to a waterproof electrical connection switch in the ground wire compartment 53, and the lock control member in the live wire compartment 51 is configured in such a manner that when a live wire pin is inserted into the live wire jack, the lock control member is connected to the live wire pin, and the live wire pin is connected to the live wire of the power supply through the waterproof electrical connection switches in the live wire compartment 51 and the ground wire compartment 53. The neutral wire of the power supply is connected to the waterproof electrical connection switch in the neutral wire compartment 52 and is connected to the lock control member in the neutral wire compartment 52, the waterproof electrical connection switch in the neutral wire compartment 52 is connected in series to the other waterproof electrical connection switch in the live wire compartment 51, and the lock control member in the neutral wire compartment 52 is configured in such a manner that when a neutral wire pin is inserted into the neutral wire jack, the lock control member is connected to the neutral wire pin, and the neutral wire pin is connected to the neutral wire of the power supply through the waterproof electrical connection switches in the neutral wire compartment 52 and the live wire compartment 51.

In a solution, for the second type of 3-pin safety socket, a specific internal circuit structure is provided. This solution improves the electric-shock-proof performance while satisfying a 3-pin socket standard. The neutral wire of the power supply is connected to one waterproof electrical connection switch in the neutral wire compartment 52 and is connected to the lock control member in the neutral wire compartment 52, one waterproof electrical connection switch in the neutral wire compartment 52 is connected in series to a waterproof electrical connection switch in the ground wire compartment 53, and the lock control member in the neutral wire compartment 52 is configured in such a manner that when a neutral wire pin is inserted into the neutral wire jack, the lock control member is connected to the neutral wire pin, and the neutral wire pin is connected to the neutral wire of the power supply through the waterproof electrical connection switches in the neutral wire compartment 52 and the ground wire compartment 53. The live wire of the power supply is connected to one waterproof electrical connection switch in the live wire compartment 51 and is connected to the lock control member in the live wire compartment 51, the waterproof electrical connection switch in the live wire compartment 51 is connected in series to the other waterproof electrical connection switch in the neutral wire compartment 52, and the lock control member in the live wire compartment 51 is configured in such a manner that when a live wire pin is inserted into the live wire jack, the lock control member is connected to the live wire pin, and the live wire pin is connected to the live wire of the power supply through the waterproof electrical connection switches in the neutral wire compartment 52 and the live wire compartment 51.

In a solution, a connection part of the waterproof electrical connection switch connected to a conductor in the bottom of the shell and an exposed part of the conductor are covered with a waterproof insulating material for waterproof treatment; and the waterproof electrical connection switch is connected to another waterproof electrical connection switch or lock control member through a conductor.

The structures such as the waterproof electrical connection switch and the lock control member in this embodiment may be supplemented or replaced by corresponding structures in other embodiments.

Although the present disclosure has been shown and described based on particular embodiments, the present disclosure is not limited to the details shown. Rather, the various details of the present disclosure may be adapted within the scope of the claims and their equivalents.

What is claimed is:

1. A safety socket module, comprising:

a shell;

an upper cover, configured to cover the shell and provided with a plurality of jacks;

compartments, wherein a number of the compartments corresponds to a number of the jacks, each of the compartments is arranged in the shell and below a respective jack of the jacks, and an interior of each of the compartments is accessible from an exterior of the shell through the respective jack;

waterproof electrical connection switches, arranged in the compartments and configured to asynchronously control connection and disconnection of a circuit between a power supply and a plug of an electric appliance, wherein a connection part of each of the waterproof electrical connection switches connected to a conductor in a bottom of the shell and an exposed part of the conductor are covered with a waterproof insulating material for a waterproof treatment; and lock control members, respectively arranged in the compartments and aligned with the jacks, and configured to clamp pins of the plug of the electric appliance and bias the waterproof electrical connection switches when the pins are inserted into the jacks, respectively, and disengage from the pins and reset the waterproof electrical connection switches when the pins are pulled out of the jacks, respectively, wherein a connection part of each of the lock control members connected to a conductor in the bottom of the shell and an exposed part of the conductor are covered with a waterproof insulating material for a waterproof treatment, each of the waterproof electrical connection switches comprises an isolated waterproof chamber, and a movable contact piece and a static contact piece arranged opposite to each other in the isolated waterproof chamber;

the isolated waterproof chamber is configured as a fully sealed structure, and a contact surface of the isolated waterproof chamber that is biased by a respective lock control member of the lock control members is elastically deformable; and the isolated waterproof chamber is a waterproof capsule, and the waterproof capsule comprises a capsule base and a waterproof rubber sleeve fixed to the capsule base;

the movable contact piece and the static contact piece are arranged inside the waterproof rubber sleeve and fixed to the capsule base by injection molding;

an insulating elastic piece is arranged between the movable contact piece and the static contact piece to assist and correct a deformation and a rebound of the movable contact piece and the static contact piece;

the movable contact piece and the static contact piece are respectively provided with contacts; and the movable contact piece and the static contact piece are configured to contact with each other through the contacts the movable contact piece is configured to contact with the static contact piece to switch on each of the waterproof electrical connection switches through biasing of the respective lock control member when the pins are inserted into the jacks, and move away from the static contact piece to switch off each of the waterproof electrical connection switches through resetting of the respective lock control member when the pins are pulled out of the jacks;

a waterproof pad made of an insulating material is arranged on the upper cover; and the waterproof pad is configured to cover a part of the upper cover and expose the jacks, and is configured to fit with the plug of the electric appliance to prevent water from entering the compartments through a gap between the plug of the electric appliance and the upper cover when the plug of the electric appliance is inserted into the jacks, and block a communication of water between the pins of the plug on a surface of the upper cover.

2. The safety socket module according to claim 1, wherein, the safety socket module further comprises a gasket, arranged between the compartments and the upper cover to seal the compartments and prevent a liquid from penetrating from one compartment to another compartment.

3. The safety socket module according to claim 1, wherein, the capsule base is made of an insulating material by injection molding; and the waterproof rubber sleeve is integrally made of an insulating, heat-resistant, and friction-resistant elastic material.

4. The safety socket module according to claim 1, wherein, a multi-rib waterproof structure made of an insulating material is arranged on the upper cover, and is configured to fit with a rubber pad mounted on the plug of the electric appliance to prevent water from entering the compartments through a gap between the plug of the electric appliance and the upper cover when the plug of the electric appliance is inserted into the jacks, and block a communication of water between the pins of the plug on a surface of the upper cover.

5. The safety socket module according to claim 1, wherein, at least two waterproof electrical connection switches controlled by the lock control members in different compartments are connected in series between a live wire of the power supply and the lock control member in the compartment of the safety socket module corresponding to the live wire; and at least one waterproof electrical connection switch is connected in series between a neutral wire of the power supply and the lock control member in the compartment of the safety socket module corresponding to the neutral wire.

6. The safety socket module according to claim 1, wherein, at least two waterproof electrical connection switches controlled by the lock control members in different compartments are connected in series between a live wire of the power supply and the lock control member in the compartment of the safety socket module corresponding to the live wire; and at least two waterproof electrical connection switches controlled by the lock control members in different compartments are connected in series between a neutral wire of the power supply and the lock control member in the compartment of the safety socket module corresponding to the neutral wire.

7. The safety socket module according to claim 6, wherein, the upper cover is provided with a live wire jack corresponding to a live wire pin of the plug of the electric appliance and a neutral wire jack corresponding to a neutral wire pin of the plug of the electric appliance;

the compartments comprise a live wire compartment arranged below the live wire jack in the shell and a neutral wire compartment arranged below the neutral wire jack in the shell; and two waterproof electrical connection switches are arranged in each of the live wire compartment and the neutral wire compartment to form a protection circuit controlled by four waterproof electrical connection switches.

8. The safety socket module according to claim 6, wherein, the upper cover is provided with a live wire jack corresponding to a live wire pin of the plug of the electric appliance, a neutral wire jack corresponding to a neutral wire pin of the plug of the electric appliance, and a ground wire jack corresponding to a ground wire pin of the plug of the electric appliance;

the compartments comprise a live wire compartment arranged below the live wire jack in the shell, a neutral wire compartment arranged below the neutral wire jack in the shell, and a ground wire compartment arranged below the ground wire jack in the shell; and a total of four waterproof electrical connection switches are arranged in the live wire compartment, the neutral wire compartment, and the ground wire compartment to form a protection circuit controlled by four waterproof electrical connection switches.

9. The safety socket module according to claim 1, wherein, the upper cover is provided with three live wire jacks corresponding to live wire pins of the plug of the electric appliance and a ground wire jack corresponding to a ground wire pin of the plug of the electric appliance;

the compartments comprise live wire compartments respectively arranged below the live wire jacks in the shell and a ground wire compartment arranged below the ground wire jack in the shell;

at least two waterproof electrical connection switches controlled by the lock control members in different compartments are connected in series between each live wire of the power supply and the lock control member in each of the live wire compartments; and a total of six waterproof electrical connection switches are arranged in the live wire compartments and the ground wire compartment to form a protection circuit controlled by six waterproof electrical connection switches.

10. The safety socket module according to claim 1, wherein, each of the lock control members is made of a conductor material and comprises a push paddle arranged perpendicularly to a bottom surface of a respective one of the compartments and a fixing component, and the fixing component comprises a pair of two clamping pieces;

a plane where the push paddle lies is perpendicular to a plane where the fixing component lies;

the push paddle comprises a bend near an end portion thereof, the bend comprises a first bending portion abutting against a respective one of the waterproof electrical connection switches and a second bending portion facing toward a respective pin of the pins, and a spacing of the push paddle is set to match a width of the respective pin, so that the push paddle biases the movable contact piece to contact with the static contact piece only when a pin conforming to a size specified in a standard is inserted into a respective jack of the jacks, and does not bias the movable contact piece to contact with the static contact piece when a pin or other conductor not conforming to the size specified in the standard is inserted into the respective jack, and that the push paddle resets when the respective pin is pulled out of the respective jack; and the two clamping pieces are opposite to each other, each of the clamping pieces is provided near an end portion thereof with a bending portion facing toward the respective pin, and a distance between the two clamping pieces is set to match a thickness of the respective pin, so that the respective pin is tightly clamped by the bending portions of the clamping pieces when being inserted into the respective jack, and the clamping pieces reset when the respective pin is pulled out of the respective jack.

11. The safety socket module according to claim 10, wherein, the bending portion of each of the clamping pieces is closer to the respective jack than the bend of the push paddle is, to ensure that when the respective pin is inserted into the respective jack, the respective pin is first tightly clamped by the pair of clamping pieces and then pushes the push paddle.

12. The safety socket module according to claim 1, wherein, each of the lock control members is made of a conductor material and comprises a split-molded push paddle arranged on a respective one of the compartments and a pair of two clamping pieces arranged perpendicularly to a bottom surface of the respective one of the compartments.

13. The safety socket module according to claim 12, wherein, a cross-section of the push paddle is configured substantially in a V-shape with an opening facing downward, a top end of the push paddle is a hinge point, one side edge of the push paddle is close to a respective jack of the jacks, and the other side edge of the push paddle is covered with an insulating bush and abuts against a respective one of the waterproof electrical connection switches;

an angle between the two side edges of the push paddle is set to match a width of a respective pin of the pins, so that the push paddle biases the movable contact piece to contact with the static contact piece only when a pin conforming to a size specified in a standard is inserted into the respective jack, and does not bias the movable contact piece to contact with the static contact piece when a pin or other conductor not conforming to the size specified in the standard is inserted into the respective jack, and that the push paddle resets when the respective pin is pulled out of the respective jack; and the two clamping pieces are opposite to each other, each of the clamping pieces is provided near an end portion thereof with a bending portion facing toward the respective pin, and a distance between the two clamping pieces is configured to match a thickness of the respective pin, so that the respective pin is tightly clamped by the bending portions of the clamping pieces to prevent a poor contact when being inserted into the respective jack, and the clamping pieces reset when the respective pin is pulled out of the respective jack.

14. A power strip, comprising:

a power strip shell, an external power cable, connected externally into the power strip shell, and an internal power cable, arranged in the power strip shell, one or more safety socket modules according to claim 1 are embedded in the power strip shell;

the power strip shell is configured to expose the upper cover(s) of the one or more safety socket modules; and the one or more safety socket modules are connected in parallel to the internal power cable.

15. The power strip according to claim 14, wherein, the power strip further comprises a mechanical switch configured to connect the external power cable to the internal power cable, and the mechanical switch comprises:

a switch button, having a depressed position and a raised position, a push member, connected to the switch button, and a switch waterproof capsule, abutting against the push member, wherein the switch waterproof capsule comprises a switch movable contact piece and a switch static contact piece opposite to each other therein;

the switch movable contact piece is connected to one of the external power cable and the internal power cable, and the switch static contact piece is connected to the other of the external power cable and the internal power cable; and the switch movable contact piece is configured to contact with the switch static contact piece to connect the external power cable to the internal power cable through biasing of the push member when the switch button is in the depressed position, and to move away from the switch static contact piece to disconnect the external power cable from the internal power cable through a retraction of the push member when the switch button is in the raised position.

16. The power strip according to claim 15, wherein, the mechanical switch comprises two switch waterproof capsules; wherein the switch movable contact piece and the switch static contact piece of one of the switch waterproof capsules are respectively connected to a live wire of the external power cable and a live wire of the internal power cable;

the switch movable contact piece and the switch static contact piece of the other of the switch waterproof capsules are respectively connected to a neutral wire of the external power cable and a neutral wire of the internal power cable; and each of the switch waterproof capsules controls closing and opening of a circuit.

17. A mobile cable reel, comprising:

a drum;

two baffles, respectively arranged on two opposing sides of the drum;

a cable reel power cable, coiled on an outer periphery of the drum;

one or more safety socket modules according to claim 1, arranged on one or both of the two baffles; and one or more drain openings, arranged on one or both of the two baffles and corresponding to the one or more safety socket modules.

* * * * *